US006633283B2

(12) United States Patent
Fukuda et al.

(10) Patent No.: US 6,633,283 B2
(45) Date of Patent: Oct. 14, 2003

(54) IMAGE PROCESSING DEVICE AND IMAGE PROCESSING METHOD

(75) Inventors: Takatoshi Fukuda, Kawasaki (JP); Kunihiko Hagiwara, Kawasaki (JP); Michio Hibi, Kawasaki (JP); Seiji Toda, Kawasaki (JP); Manabu Suzuki, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 198 days.

(21) Appl. No.: 09/795,492

(22) Filed: Mar. 1, 2001

(65) Prior Publication Data

US 2002/0015053 A1 Feb. 7, 2002

(30) Foreign Application Priority Data

Aug. 4, 2000 (JP) ..... 2000-237573

(51) Int. Cl.[7] ..... G09G 5/00

(52) U.S. Cl. ..... 345/204; 345/660; 345/694; 345/690; 345/699

(58) Field of Search ..... 345/694, 699, 345/204, 660, 698

(56) References Cited

U.S. PATENT DOCUMENTS 5,909,205 A * 6/1999 Furuhashi et al. ..... 345/98
6,348,931 B1 * 2/2002 Suga et al. ..... 345/699

* cited by examiner

*Primary Examiner*—Richard Hjerpe
*Assistant Examiner*—Jean Lesperance
(74) *Attorney, Agent, or Firm*—Staas & Halsey LLP

(57) ABSTRACT

A storing part stores image data of an input image signal; and a control part detects a resolution of the image data from a synchronization signal which is in synchronization with the input image signal, and, controls timing of reading the image data from the storing part according to the thus-detected resolution. The control part detects periods of a horizontal synchronization signal and vertical synchronization signal which are in synchronization with the input image signal, determines a magnification for an image to be output, from a horizontal synchronization interval and a vertical synchronization interval of the image to be output, and the periods of the horizontal synchronization signal and vertical synchronization signal which are in synchronization with the input image signal; and controls the timing of reading the image data from said storing part according to the thus-determined magnification.

10 Claims, 18 Drawing Sheets

IMAGE PROCESSING DEVICE AND IMAGE PROCESSING METHOD

BACKGROUND OF THE INVENTION

1. Field of the Invention

The present invention relates to an image processing device and an image processing method, and, in particular, an image processing device and an image processing method of processing images to be displayed on a display device.

Recently, a CRT (Cathode Ray Tube) display device has been widely used as a display device of a host computer such as a personal computer, a work station or the like. However, a flat-panel display devices such as a liquid crystal panel, a plasma display device and so forth have drawn attentions.

A signal provided from a personal computer to a CRT display device or a flat-panel display device is a video signal. The video signal generally includes analog image data, vertical and horizontal synchronization signals (VS, HS signals), or a composite signal which is a combination of these signals.

Such a video signal may have any of different specifications. Sometimes, a personal computer renders a plurality of different resolutions. As these specifications, there are various resolutions such as 320 dots×200 dots, 640×400 dots, 720 dots×400 dots, 640 dots×350 dots, 640 dots×480 dots, 800 dots×600 dots, 1024 dots×768 dots, 1280 dots×1024 dots, and so forth.

A so-called multi-sync CRT display device is used for dealing with these resolutions. The multi-sync CRT display device measures the synchronization signals of the video signal, causes a driving period and a moving width of a scanning line to correspond to the synchronization signals of the video signal, and, thereby, deals with the resolutions. This is possible because the pitch of a shadow mask which determines the minimum display pixel of the CRT display device is smaller than the pixel pitch according to the display resolution of the video signal.

However, with regard to dot-matrix display devices such as a liquid crystal penal, a plasma display device and so forth, because the pixel thereof is larger than that of the shadow mask of the CRT, the processing performed by the multi-sync CRT display device cannot be performed by the dot-matrix display device. Therefore, analog-to-digital conversion is performed on the input analog video signal in synchronization with the resolution (dot clock signal) of the input analog video signal, interpolation is performed so as to generate a signal corresponding to the output resolution of the dot-matrix display device in each of horizontal and vertical directions, and, thereby, display is made by the display device.

2. Description of the Related Art

FIG. 1 is a block diagram showing one example of an image display device in the related art.

In FIG. 1, the image display device 20 is a device of driving a dot-matrix display device using an analog image signal, and, performs display based on the image signal from a personal computer 10. The personal computer 10 includes a VGA (Video Graphics Array) controller 11 built therein. The image signal is provided to the image display device 20 via the VGA controller 11.

The VGA controller 11 provides RGB (Red, Green, Blue) signals 12, HS (Horizontal Scan) and VS (Vertical Scan) signals 13 according to the images, to the image display device 20.

The image display device 20 includes an A-D converter 21, an image processing part 22, an LCD panel 23, PLL (Phase Locked Loop) circuits 24, 26, and a system control part 25.

The analog video signals (RGB signals 12 and HS and VS signals 13) are provided to the A-D converter 21, and the HS and VS signals 13 are also provided to the system control part 25.

The A-D converter 21 converts the analog video signals from the VGA controller 11 into digital signals in synchronization with a clock signal from the PLL circuit 24.

The system control part 25 controls the PLL circuits 24, 26, A-D converter 21 and image processing part 22 in synchronization with the HS and VS signals 13.

The PLL circuit 24 provides a clock signal in phase with the HS and VS signals from the system control part 25, to the A-D converter 21, and controls the conversion timing of the A-D converter 21.

The PLL circuit 26 provides the clock signal in phase with the HS and VS signals from the system control part 25, to the image processing part 22 and LCD panel 23, and controls the driving timing of the image processing part 22 and LCD panel 23.

The image processing part 22 converts the digital signals given from the A-D converter 21 into signals of resolution corresponding to the LCD panel 23 using a control signal from the system control part 25 and the clock signal from the PLL circuit 26. The image processing part 22 includes a FIFO (First-In-First-Out) built therein, and stores the thus-converted signals into the FIFO. These image signals are provided to the LCD panel 23.

The LCD panel 23 holds data of the image signals given by the image processing part 22 in response to the clock signal given by the PLL circuit 26, and performs display based on the held data.

FIG. 2 is a block diagram showing another example of an image display device in the related art.

In FIG. 2, the image display device 30 is a device of driving a dot-matrix display device using digital image signals, and, performs display based on the image signals from a personal computer 15. The personal computer 15 includes a VGA (Video Graphics Array) controller 16 built therein. The image signals are provided to the image display device 30 via the VGA controller 16. The VGA controller 16 provides the RGB (Red, Green, Blue) signal 17, DE (Data Enable), CLK, HS and VS signals 18 according to the images, to the image display device 30.

The image display device 30 includes an image processing part 31, an LCD panel 32, a PLL (Phase Locked Loop) circuit 34 and a system control part 33.

The video signals (RGB signal 17 and DE, CLK, HS and VS signals 18) are provided to the image processing part 31, and DE, CLK, HS and VS signals 18 are also provided to the system control part 33.

The system control part 33 controls the PLL circuit 34 and image processing part 31 in synchronization with the DE, CLK, HS and VS signals 18.

The PLL circuit 34 provides a clock signal in phase with the DE, CLK, HS and VS signals from the system control part 33, to the image processing part 31 and LCD panel 32, and controls the driving timing of the image processing part 31 and LCD panel 32.

The image processing part 31 converts the digital signals given from the VGA controller 16 into signals of resolution corresponding to the LCD panel 32 using a control signal from the system control part 33 and the clock signal from the PLL circuit 34. The image processing part 31 includes a FIFO (First-In-First-Out) built therein, and stores the thus-converted signals into the FIFO. These image signals are provided to the LCD panel 32.

The LCD panel 32 holds data of the image signals given by the image processing part 31 in response to the clock signal given by the PLL circuit 32, and performs display based on the held data.

FIGS. 3A through 3F show waveforms of the digital signals in the related art.

FIG. 3A shows the VS signal input to the image processing part 31 shown in FIG. 2; FIG. 3B shows the DE signal; FIGS. 3C and 3D show the HS signal, FIG. 3E shows the video (RGB) signal and FIG. 3F shows the DE signal. In this example, it is assumed that the input video signal is of VGA mode (640×480 dots, 75 Hz), for example.

The VS signal shown in FIG. 3A has a pulse wave having a period of 13.3 ms. When the VS signal has the high level, a vertical scanning signal updating an image is input.

The DE signal shown in FIG. 3B has a synchronization interval when the VS signal has the low level, and has a vertical back-porch interval immediately after the VS signal rises up from the low level to the high level. The DE signal has a vertical effective image interval after the vertical back-porch interval has elapsed. The vertical effective image interval of the DE signal is 12.8 ms (for 480 lines). The DE signal has a vertical front-porch interval after the vertical effective image interval has elapsed, until the VS signal decays down from the high level to the low level.

The HS signal shown in FIGS. 3C and 3D has a pulse wave having a period of 26.7 $\mu$s. When the HS signal has the high level, a horizontal scanning signal for scanning in the horizontal direction of the image is input.

The video (RGB) signal shown in FIG. 3E has effective data after a horizontal synchronization interval (for 64 pixels) of the low level of the pulse of the HS signal and a horizontal back-porch interval (for 120 pixels) starting from the rising up of the HS signal have elapsed. The video signal comes to have effective data during a horizontal effective image interval (for 640 pixels), and is effective during this interval. After the horizontal effective image interval of the video signal, a horizontal blanking interval (horizontal retrace/fly-back interval) starts preceding the time the HS signal decays from the high level to the low level by a horizontal front-porch interval (for 16 pixels). The DE signal shown in FIG. 3F has the high level while the video signal is effective.

As mentioned above, the clock signal used for driving the LCD panel 23/32 is generated by the PLL circuit 26/34 in each of the image display devices shown in FIGS. 1 and 2.

Thus, in the image display devices in the related art, the predetermined frequency for determining the timing of reading of the image data to be output to the LCD panel is determined according to the respective resolutions of the video signals given from the personal computer. This determination is performed by the system control part 25/33 including a CPU, a memory, and programs stored in the memory, not shown in the figures. For this process, programming has been previously made such that examination is performed previously only for the video signals which are previously expected to be input, and the interpolation (conversion) processing according to the output resolutions are performed. Accordingly, it is not possible to deal with the video signals other than those which are perilously expected to be input.

Thus, control in accordance with input variation in the video signal is not performed. Therefore, the timing of reading of the image data from the FIFO in the actual interpolation (conversion) processing according to the output resolution is severe. As a result, it is necessary that a plurality of types of the reading timings are set within the allowable range of the LCD panel. Thereby, the PLL should be able to output the plurality of frequencies variably, for the timings of reading the image data from the FIFO.

However, the PLL has a complicated function such that the frequency of the output clock signal is changed in accordance with input conditions. Therefore, jitter may easily occur such that the phase of the output clock signal changes. Due to the jitter, the timing of taking in of the image data by the LCD panel becomes severe, and, thereby, error may occur in the image data, and flickering may occur in the displayed image.

In order to solve this problem, it can be considered to provide the FIFO having a sufficient capacity such as that for one frame, for example. However, because the FIFO is expensive, this method is not practical.

SUMMARY OF THE INVENTION

An object of the present invention is to solve this problem, and to provide an image processing device and an image processing method by which precise image processing can be performed with a memory having a small capacity, and the device can be simplified.

An image processing device according to the present invention comprises:

a storing part storing image data of an input image signal; and a control part detecting a resolution of the image data from a synchronization signal which is in synchronization with the input image signal, and, controlling timing of reading the image data from the storing part according to the thus-detected resolution.

Thereby, the resolution of the image data is detected according to variation in the input image signal, and the timing of reading the image data from the storing part is controlled accordingly. As a result, it is possible to perform image processing properly without providing a PLL circuit which can output various frequencies through control, and with a FIFO having a small capacity. Thus, it is possible to simplify the image display device.

The control part may have a data enable signal input thereto as the synchronization signal which is in synchronization with the input image signal, detect the number of data enable signal pulses within one frame of the input image signal in the data enable signal, and determine, as a magnification in a vertical direction, a value obtained as a result of a resolution in the vertical direction of an image to be output being divided by the above-mentioned number of data enable signal pulses within one frame;

the data enable signal which is in synchronization with the input image signal and a clock signal which is in synchronization with the reading timing for the image data may be provided to the control part;

a pulse width of the data enable signal may be counted by using the clock signal, and, the value obtained as a result of the resolution in a horizontal direction of the image to be output being divided by a thus-obtained count value may be determined as a magnification in the horizontal direction, by the control part; and the control part may control the timing of reading the image data from the storing part according to the thus-obtained magnification in the vertical direction and magnification in the horizontal direction.

Thereby, the control part detects the number of data enable signal pulses as the synchronization signal which is in synchronization with the input image signal, and controls the timing of reading of the image data from the storing part according to the magnification in the vertical direction and magnification in the horizontal direction detected by using the thus-detected number of the data enable signal pulses and count value of the pulse width thereof. Thereby, it is possible to perform image processing properly without providing a PLL circuit which can output various frequencies through control, and with a FIFO having a small capacity.

An image processing device according to another aspect of the present invention, comprises:

a storing part storing image data of an input image signal; and a control part detecting periods of a horizontal synchronization signal and vertical synchronization signal which are in synchronization with the input image signal, determining a magnification for an image to be output, from a horizontal synchronization interval and a vertical synchronization interval for the image to be output, and the periods of the horizontal synchronization signal and vertical synchronization signal which are in synchronization with the input image signal; and controlling timing of reading the image data from the storing part according to the thus-determined magnification.

Thereby, the magnification for the image to be output is detected from the horizontal synchronization interval and vertical synchronization interval for the image to be output, and the periods of the horizontal synchronization signal and vertical synchronization signal which are in synchronization with the input image signal, and the timing of reading the image data from the storing part is controlled according to the thus-determined magnification. Thereby, it is possible to perform image processing properly without providing a PLL circuit which can output various frequencies through control, and with a FIFO having a small capacity.

The device may further comprise a clock generating part generating a predetermined clock signal according to the resolution of the image to be output; and the control part may read the image data from the storing part in synchronization with the clock signal generated by the clock generating part.

Thereby, it is possible to perform image processing properly without providing a PLL circuit which can output various frequencies through control, and with a FIFO having a small capacity.

The control part may count an interval obtained as a result of a vertical blanking interval being removed from one frame of the image signal, using the clock signal generated by the clock generating part, set, as a horizontal blanking interval for the image to be output, a value obtained from dividing the thus-obtained count value by a resolution in the vertical direction of the image to be output, and subtracting a resolution in the horizontal direction of the image to be output from the division result, and read the image data from the storing part according to the thus-set horizontal blanking interval and the above-mentioned magnification.

Thereby, it is possible to perform image processing properly without providing a PLL circuit which can output various frequencies through control, and with a FIFO having a small capacity.

The control part may update the horizontal blanking interval for each frame of the input image signal.

Thereby, it is possible to perform reading the image data from the storing part with a FIFO having a small capacity as the storing part.

The control part may update the horizontal blanking interval according to a difference between a writing time and a reading time for the storing part.

Thereby, it is possible to perform reading the image data from the storing part with a FIFO having a small capacity as the storing part.

The control part may update the horizontal blanking interval according to a data amount of the storing part.

Thereby, it is possible to perform reading the image data from the storing part with a FIFO having a small capacity as the storing part.

An image processing method according to the present invention, comprises the steps of:

a) storing image data of an input image signal in a storing part; and b) detecting a resolution of the image data from a synchronization signal which is in synchronization with the input image signal, and, controlling timing of reading the image data from the storing part according to the thus-detected resolution.

Thereby, the resolution of the image data is detected according to variation in the input image signal, and the timing of reading the image data from the storing part is controlled accordingly. As a result, it is possible to perform image processing properly without providing a PLL circuit which can output various frequencies through control, and with a FIFO having a small capacity. Thereby, it is possible to simply the display device.

Other objects and further features of the present invention will become more apparent from the following detailed description when read in conjunction with the accompanying drawings.

DETAILED DESCRIPTION OF THE PREFERRED EMBODIMENTS

Figure 1:
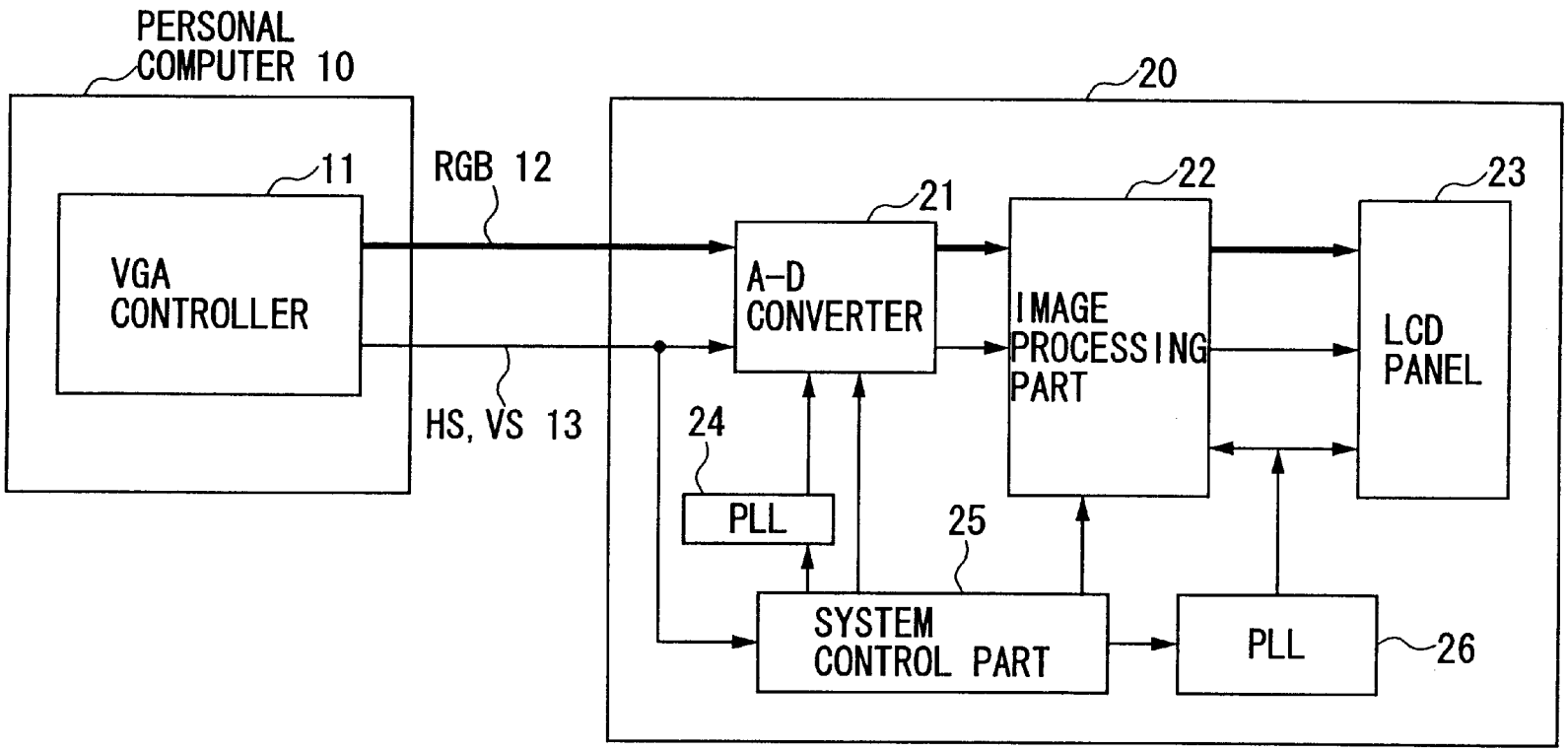
FIG. 1 is a block diagram showing one example of an image display device in the related art.
Figure 2:
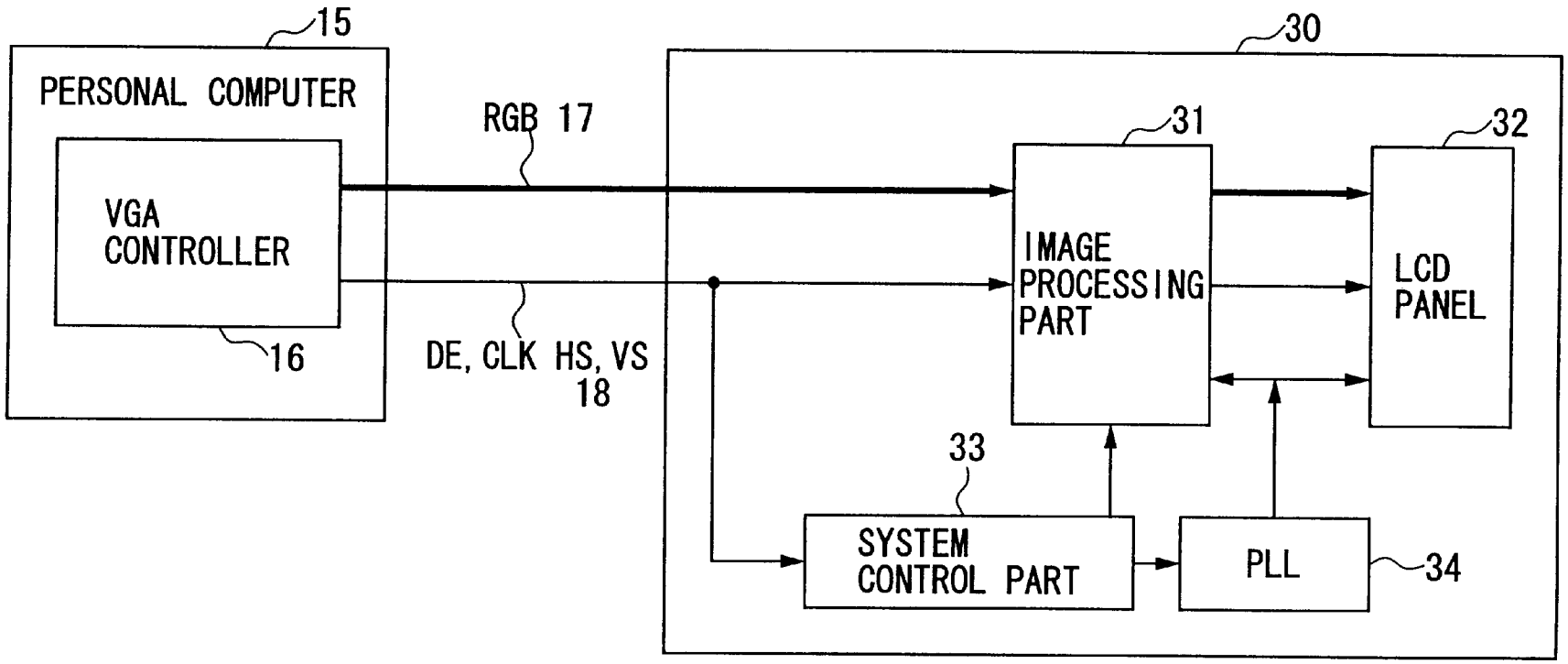
FIG. 2 is a block diagram showing another example of an image display device in the related art.
Figures 3A, 3B, 3C, 3D, 3E, 3F:
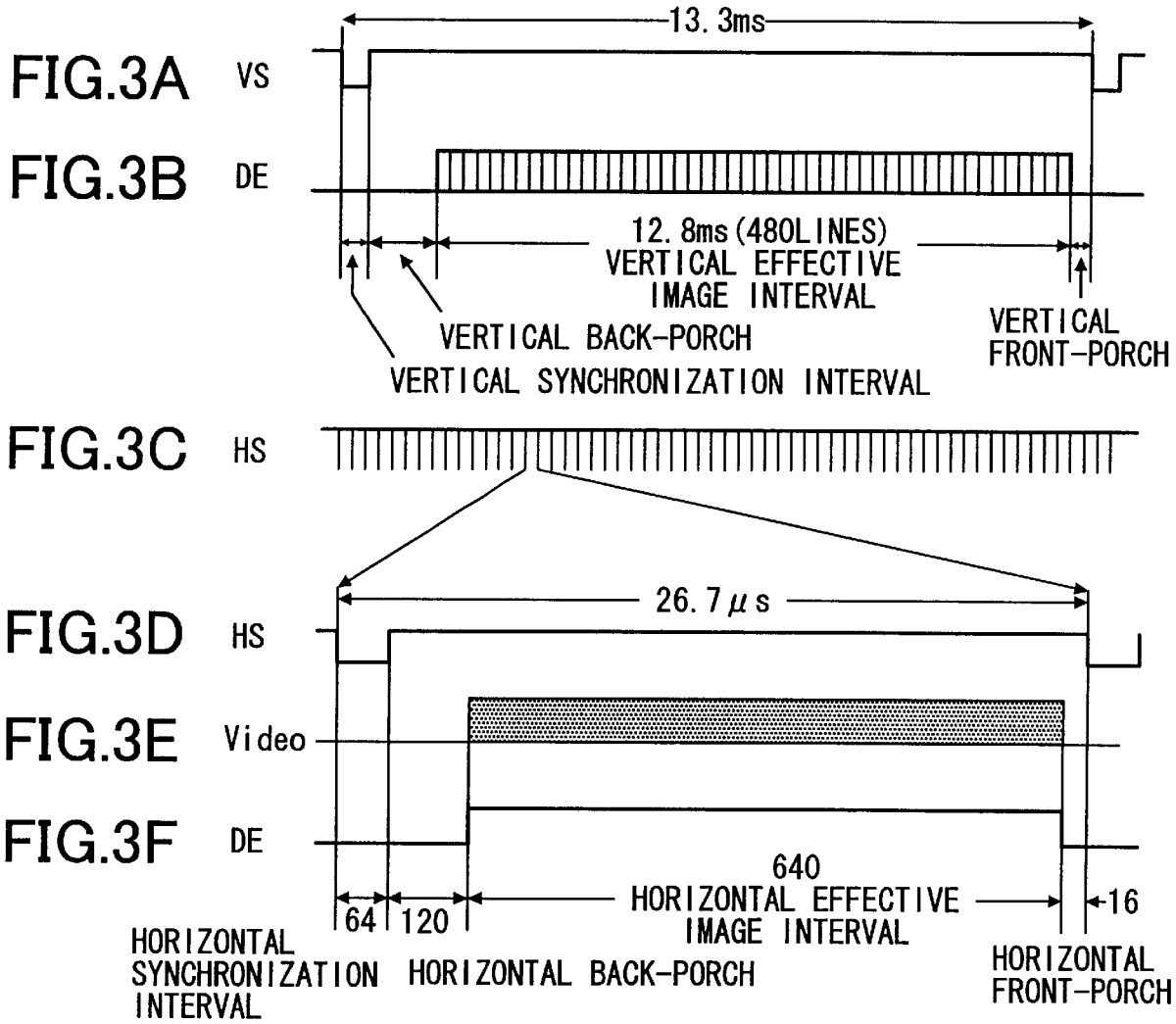
FIGS. 3A, 3B, 3C, 3D, 3E and 3F show waveforms of digital signals used in the image display device shown in FIG. 2, for example.
Figure 4:
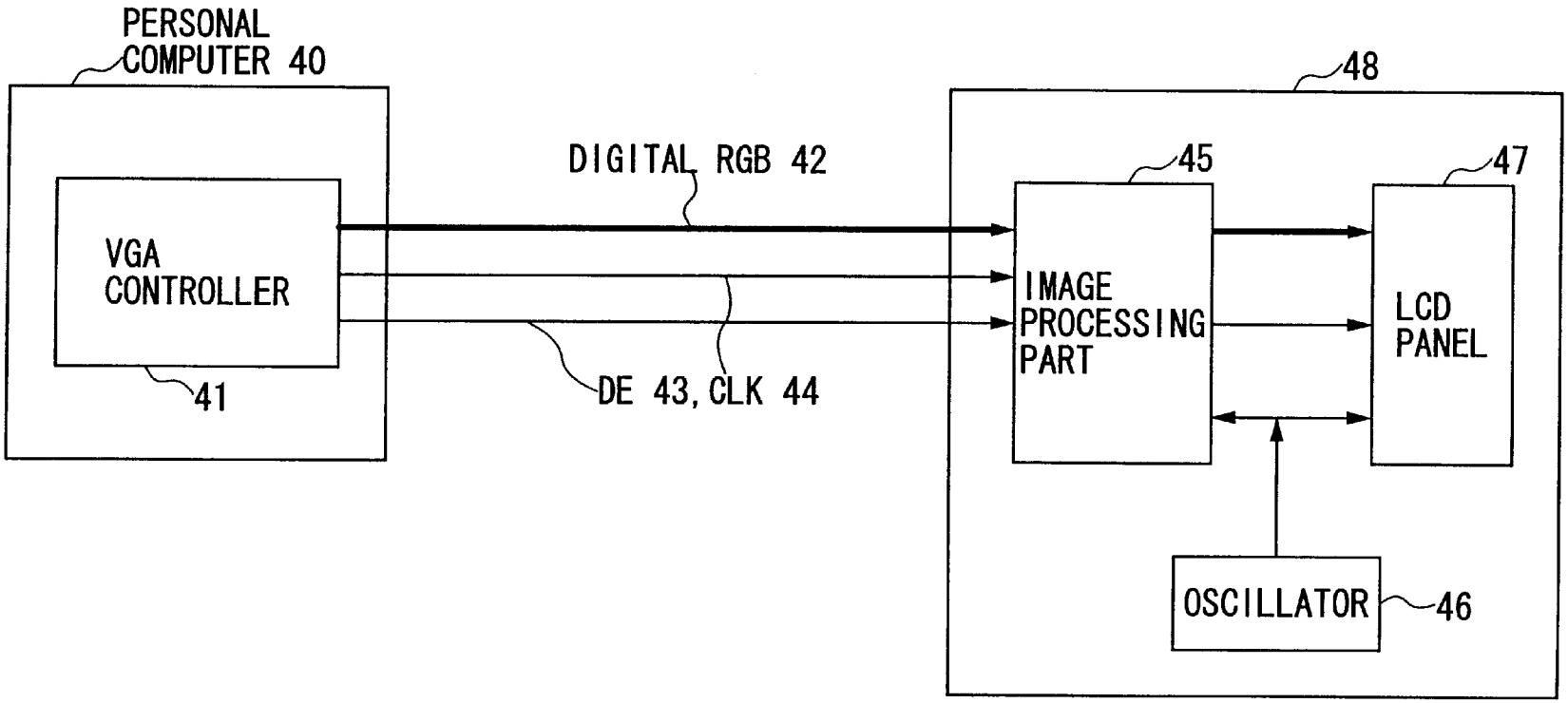
FIG. 4 is a block diagram showing an image display device in a first embodiment of the present invention.

FIG. 4 is a block diagram showing an image display device in a first embodiment of the present invention.

As shown in FIG. 4, the image display device 48 displays an image in accordance with digital video signals given from a personal computer 40. The personal computer 40 includes a VGA controller 41, and so forth (not shown in the figure). The personal computer 40 provides an RGB signal 42, a DE signal 43 and a CLK signal 44, as the digital video signals, to the image display device 48.

The image display device 48 includes an image processing part 45, an LCD panel 47, and an oscillator 46. In the image display device 48, the digital video signals (RGB signal 42, DE signal 43 and CLK signal 44) provided from the personal computer 40 are provided to the image processing part 45.

The image processing part 45 converts the RGB signal into a signal of resolution corresponding to the LCD panel 47 in accordance with the DE signal 43, CLK signal 44 and a clock signal given from the oscillator 46. The thus-obtained image signal corresponding to the LCD panel 47 is synchronized with the clock signal oscillated by the oscillator 46, and, is provided to the LCD panel 47.

The oscillator 46 provides the clock signal having a fixed frequency corresponding to the resolution of the LCD panel 47, to the image processing part 45 and LCD panel 47. The clock signal is set so that the clock signal is in synchronization with the DE signal 43 and CLK signal 44 provided to the image processing part 45.

The LCD panel 47 displays an image according to the resolution of the LCD panel 47 using the image signal from the image processing part 45 and clock signal from the oscillator 46.

Figure 5:
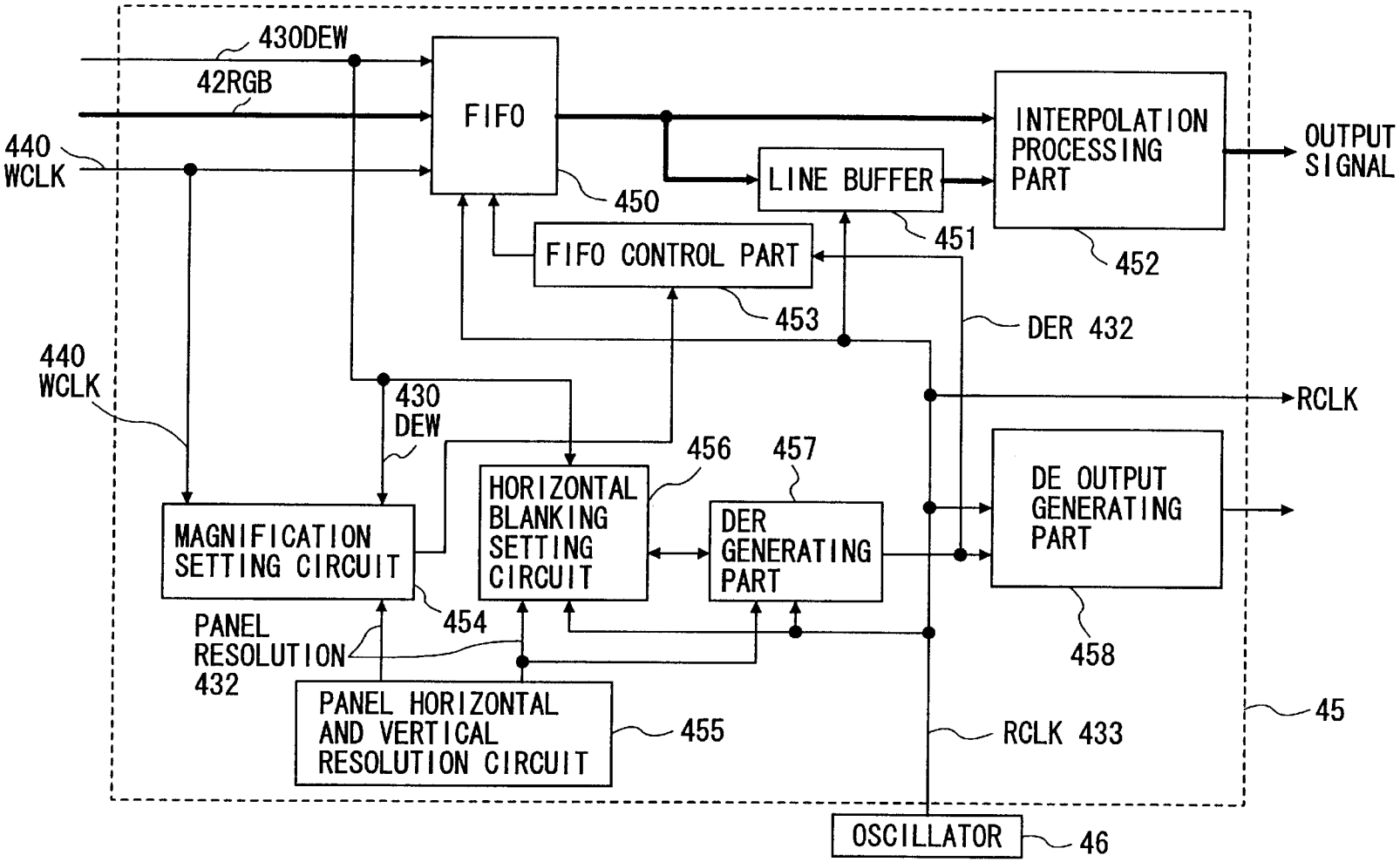
FIG. 5 is a block diagram showing an image processing part shown in FIG. 4.

FIG. 5 is a block diagram showing the image processing part 45 shown in FIG. 4.

As shown in FIG. 5, the image processing part 45 includes a FIFO (First-In-First-Out) 450, a line buffer 451, an interpolation processing circuit 452, a FIFO control part 453, a magnification setting circuit 454, a panel horizontal and vertical resolution circuit 455, a horizontal blanking setting circuit 456, a DER generating part 457 and a DE output generating part 458.

To the FIFO 450, the RGB signal 42, DE signal 43 and CLK signal 44 are provided by the personal computer 40, an RCLK signal 433 which is a clock signal for reading is provided by the oscillator 46, and a control signal is provided by the FIFO control part 453. Further, to the FIFO 450, a writing DE signal (DEW) 430 of the DE signal and a writing CLK signal (WCLK) 440 of the CLK signal 44 are provided. The FIFO 450 performs writing to and reading from a memory according to these input signals, and provides the signals to the line buffer 451 and interpolation processing part 452.

The line buffer 451, according to the data from the FIFO 450 and RCLK signal 433 from the oscillator 46, stores data resulting from delaying for one line of the image data output from the FIFO 450, and transfers the thus-obtained data to the interpolation processing part 452.

The interpolation processing part 452 performs interpolation using the image signals from the FIFO 450 and line buffer 451. The interpolation processing part 452 produces an image corresponding to the resolution of the LCD panel 47 in the vertical direction, and outputs the thus-obtained signal to the LCD panel 47. The interpolation processing part 452 also generates an horizontal synchronization signal (PHS) and a vertical synchronization signal (PVS) according to the LCD panel 47.

The FIFO control part 453, using a signal from the magnification setting circuit 454 and a reading DE signal (DER) 432 from the DER generating part 457, generates a control signal for controlling the RGB signal 42 so as to cause it to be suitable to the properties (resolution, maximum frequency, maximum horizontal frequency and so forth) of the LCD panel 47. This control signal is sent to the FIFO 450.

The magnification setting circuit 454, using the DEW signal 430, WCLK signal 431 and a panel resolution signal 434 from the horizontal and vertical panel resolution circuit 455, sets a magnification for the image, and provides a signal of the set magnification for the image to the FIFO control part 453. With regard to the magnification for the image, when the magnification for the image is such as vertical 1.6×horizontal 1.6, the frequency of a clock signal such as 31.5 MHz×1.6×1.6=80.64 MHz is needed. However, in the embodiment, the maximum frequency of the LCD panel 47 is fixed to be 65 MHz.

The panel horizontal and vertical resolution circuit 455 outputs the signal 434 of panel resolutions of horizontal and vertical directions to the magnification setting circuit 454 and horizontal blanking setting circuit 456.

The horizontal blanking setting circuit 456, using the DEW signal 430, panel resolution signal 434 and RCLK signal 433, sets a blanking interval (horizontal blanking interval) for the image in the horizontal direction, and provides the thus-set value to the DER generating part 457.

The DER generating part 457, using the RCLK signal from the oscillator 46 and the signal from the horizontal blanking setting circuit 456, generates a DER signal 432 for determining reading of signal, and provides this DER signal 432 to the DE output generating part 458 and FIFO control part 453.

The DE output generating part 458, using the RCLK signal 433 and DER signal 432, outputs a DE signal corresponding to the LCD panel 47.

Figure 6:
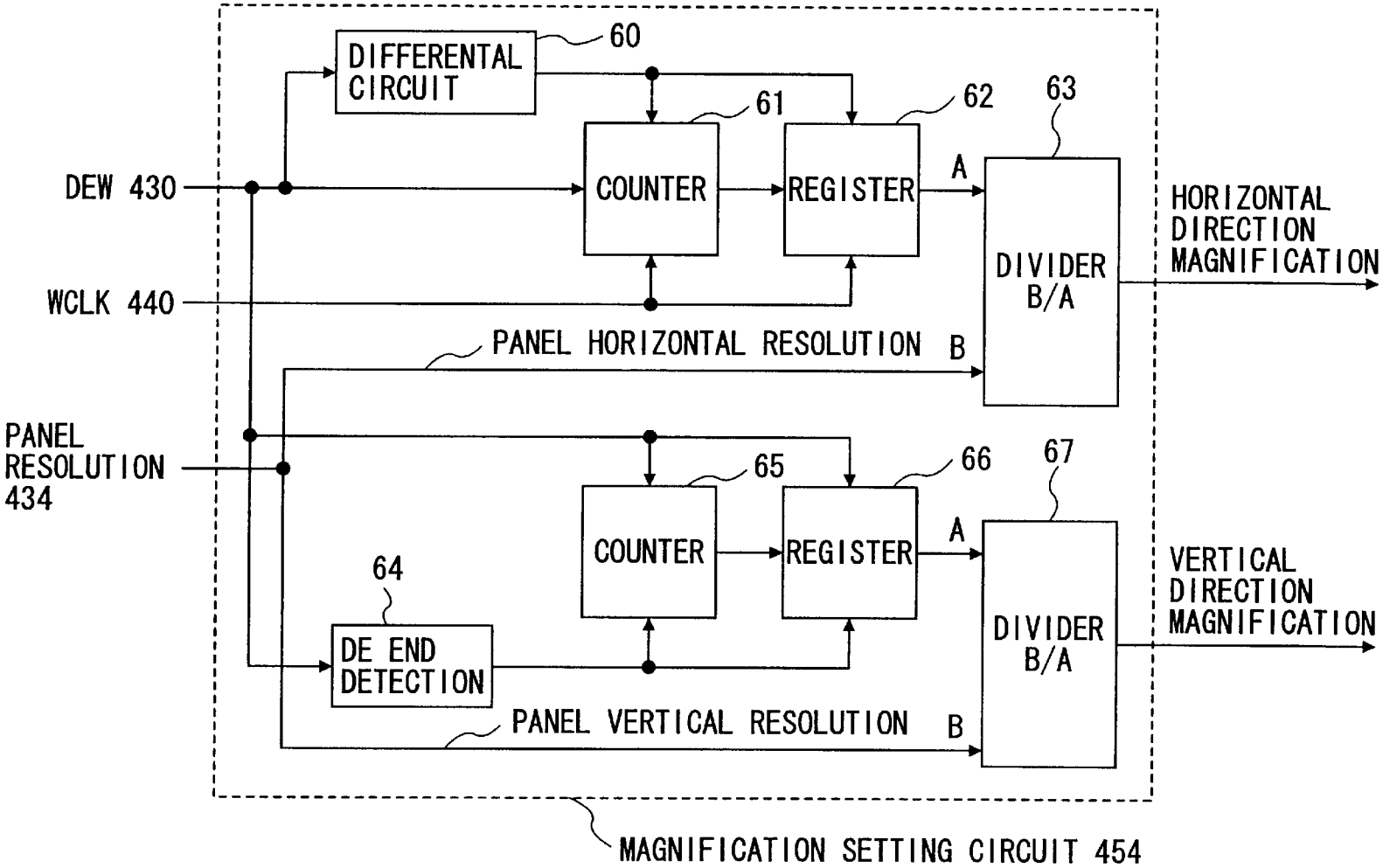
FIG. 6 is a block diagram showing a magnification setting circuit shown in FIG. 5.

FIG. 6 is a block diagram showing the magnification setting circuit 454 shown in FIG. 5.

As shown in FIG. 6, the magnification setting circuit 454 includes a differential circuit 60, counters 61, 65, registers 62, 66, dividers 63, 67, and a DE end detecting circuit 64.

The magnification setting circuit 454 has the DEW signal 43, WCLK signal 440 and panel resolution signal 434 provided thereto, and, therefrom, generates and outputs the magnification in the horizontal direction and the magnification in the vertical direction.

The differential circuit 60 has the DEW signal 430 provided thereto, and differentiates the DEW signal 430. Thus, the differential circuit 60 provides a signal to the counter 61 and register 62 at the time of decaying down of the DEW signal 430.

The counter 61 has the DEW signal 430 and WCLK signal 431 provided thereto. Then, the counter 61 starts counting clock pulses of the WCLK signal 431 at the time of rising up of the DEW signal 430. Further, the counter 61 provides the count value to the register 62 in response to the signal from the differential circuit 60 at the time of the decaying down of the DEW signal 430, and then clears the count value.

The register 62 has the signal from the differential circuit 60, the count value of the counter 61, and the WCLK signal 431 provided thereto. Then, the counter 62 stores the provided count value in response to the signal from the differential circuit 60, and provides the count value to the divider 63.

The divider 63 has the signal from the register 62 and resolution in the horizontal direction from the panel resolution circuit 434 provided thereto. Then, the divider 63 divides the panel resolution in the horizontal direction by the count value from the register 62, and outputs the division result as the magnification in the horizontal direction.

For example, it is assumed that the output of the register 62 is 640, the resolution of the LCD panel in the horizontal direction is 1024 dots, and the divider 63 performs division operation thereon. Then, 1024/640=1.6 is obtained as the magnification in the horizontal direction.

On the other hand, the DE end detecting circuit 64, using the provided DEW signal 430, detects a case where rising up of the DEW signal 430 does not occur for a long duration. The DE end detecting circuit 64 provides the detection signal to the counter 65 and register 66.

The counter 65 has the DEW signal 430 and the signal from the DE end detecting circuit 64 provided thereto. Then, the counter 65 counts the pulses of the DEW signal 430 for an interval of one frame, and provides the count value to the register 66 in response to the signal from the DE end detecting circuit 64, and then clears the count value.

The register 66 has the signal from the DE end detecting circuit 64, the count value from the counter 65 and DEW signal 430 provided thereto. Then, the register 66 stores the count value from the counter 65 in response to the signal from the DE end detecting circuit 64, and provides the count value to the divider 67.

The divider 67 has the signal from the register 66 and the resolution in the vertical direction from the panel resolution circuit 434 provided thereto. Then, the divider 67 divides the resolution in the vertical direction by the count value from the register 66, and outputs the division result as the magnification in the vertical direction.

For example, it is assumed that the output of the register 66 is 480, the resolution of the LCD panel in the vertical direction is 768 dots, and the divider 67 performs division operation thereon. Then, 768/480=1.6 is obtained as the magnification in the vertical direction.

The magnifications in the horizontal and vertical directions output from the above-mentioned dividers 63 and 67 are provided to the FIFO control part 453.

Figure 7:
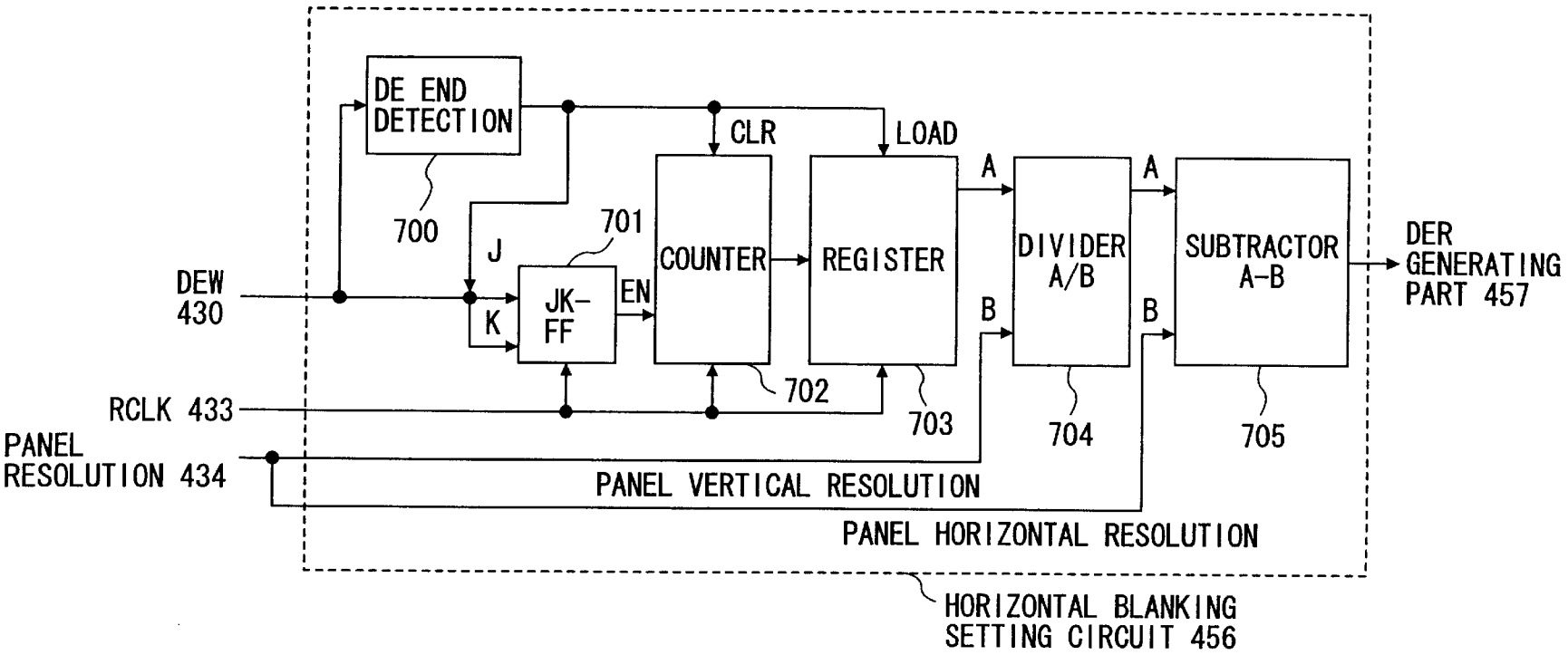
FIG. 7 is a block diagram showing a horizontal blanking setting circuit shown in FIG. 5.

FIG. 7 is a block diagram showing the horizontal blanking setting circuit 456 shown in FIG. 5.

As shown in FIG. 7, the horizontal blanking setting circuit 456 includes a DE end detecting circuit 700, a JK-FF 701, a counter 702, a register 703, a divider 704, and a subtractor 705.

The DE end detecting circuit 700 has the DEW signal 430 provided thereto, detects a case where rising up of the DEW signal does not occur for a long duration, and provides the detection signal to the JK-FF 701, counter 702 and register 703.

The JK-FF 701 has the DEW signal 430, the signal from the DE end detecting circuit 700 and the RCLK signal 433 provided thereto. The JK-FF 701 outputs '1' when the provided DEW signal rises up and the JK-FF 701 becomes active, and, outputs '0' when the signal from the DE end detecting circuit 700 becomes '1'.

The counter 702 has the RCLK signal 433, the signal from the JK-FF 701 and the detection signal from the DE end detecting circuit 700 provided thereto. Then, the counter 702 uses the RCLK signal 433 as a clock signal, counts the clock pulses thereof while the signal from the JK-FF 701 is '1', and provides the final count value to the register 703 in response to the detection signal from the DE end detecting circuit 700.

The register 703 has the RCLK signal 433, the count value of the counter 702 and the detection signal from the DE end detecting circuit 700 provided thereto. Then, the register 703 stores the count value from the counter 702, and provides the count value to the divider 704 in response to the detection signal from the DE end detecting circuit 700.

The divider 704 divides the count value provided by the register 703 by the resolution in the vertical direction from the panel resolution circuit 434. The division result is provided to the subtractor 705.

The subtractor 705 subtracts the resolution in the horizontal direction from the panel resolution circuit 434, from the value from the divider 704, and thus obtains the horizontal blanking value. This horizontal blanking value is provided to the DER generating part 457.

For example, the active interval of the JK-FF 701 is calculated as follows:

{the number of effective horizontal lines (480)}×{one horizontal interval (1/37.5 kHz)}=12.8 (ms).

Then, sampling is performed using the RCLK signal (65 MHz) during this interval. Then, the output of the register 703 is:

12.8 (ms)×65 (MHz)=832000

The divider 704 outputs the following value:

{output of the register 703 (832000)}/{resolution of the LCD panel in the vertical direction (768)}=1083.33

The subtractor 705 outputs the following value:

1083.33−{horizontal resolution of the LCD panel (1024)}~59

This value (59 in this example) is provided to the DER generating part 457 as the horizontal blanking value.

Figure 8:
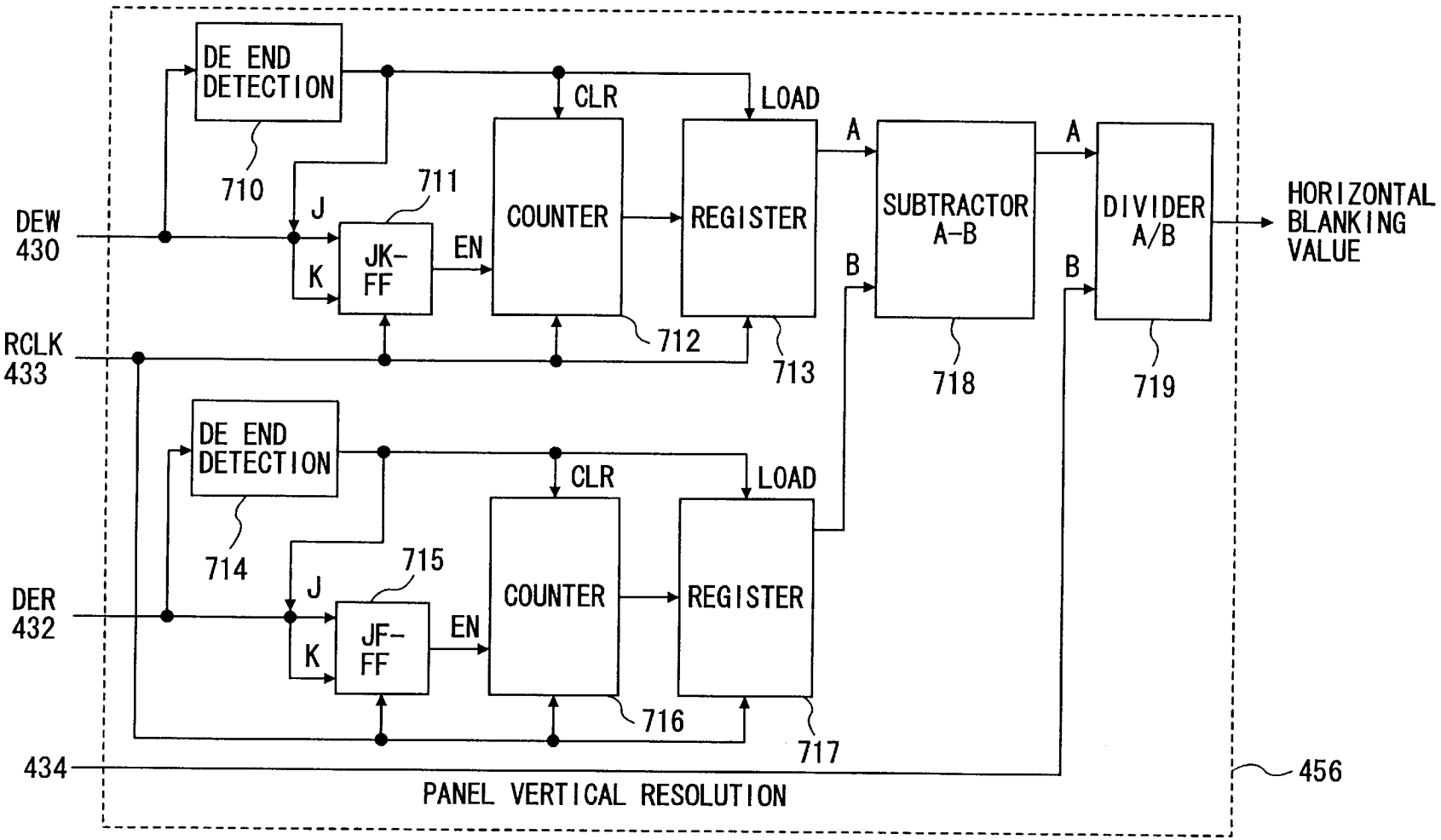
FIG. 8 is a block diagram showing a horizontal blanking setting circuit in a first variant example which may be additionally or alternatively provided in the above-mentioned first of the present invention.

FIG. 8 shows a horizontal blanking setting circuit 456 in a first variant example which may be provided additionally or alternatively in the above-described first embodiment of the present invention.

The horizontal blanking setting circuit 456 shown in FIG. 8 includes DE end detecting circuits 710, 714, JK-FF 711, 715, counters 712, 716, registers 713, 717, a subtractor 718, and a divider 719.

Similarly to the case of FIG. 7, the active interval of the DEW signal 430 is measured by the DE end detecting circuit 710, JK-FF 711, counter 712 and register 713. In addition, in the configuration of FIG. 8, measurement is performed by the DE end detecting circuit 714, JK-FF 715, counter 716 and register 717 for the reading DE signal (DER) 432 for reading from the FIFO 450.

The subtractor 718 subtracts the value of register 717 for the DER signal 432 from the value of the register 713 for the DEW signal 430. The subtraction result is provided to the divider 719.

The divider 719 divides the provided value of subtraction result by the vertical resolution of LCD panel. The division result is provided to the DER generating part 457 as the horizontal blanking value after the present horizontal blanking value (which may have been obtained through the horizontal blanking interval setting circuit shown in FIG. 7 or the like) for the DER is added thereto.

Figure 9:
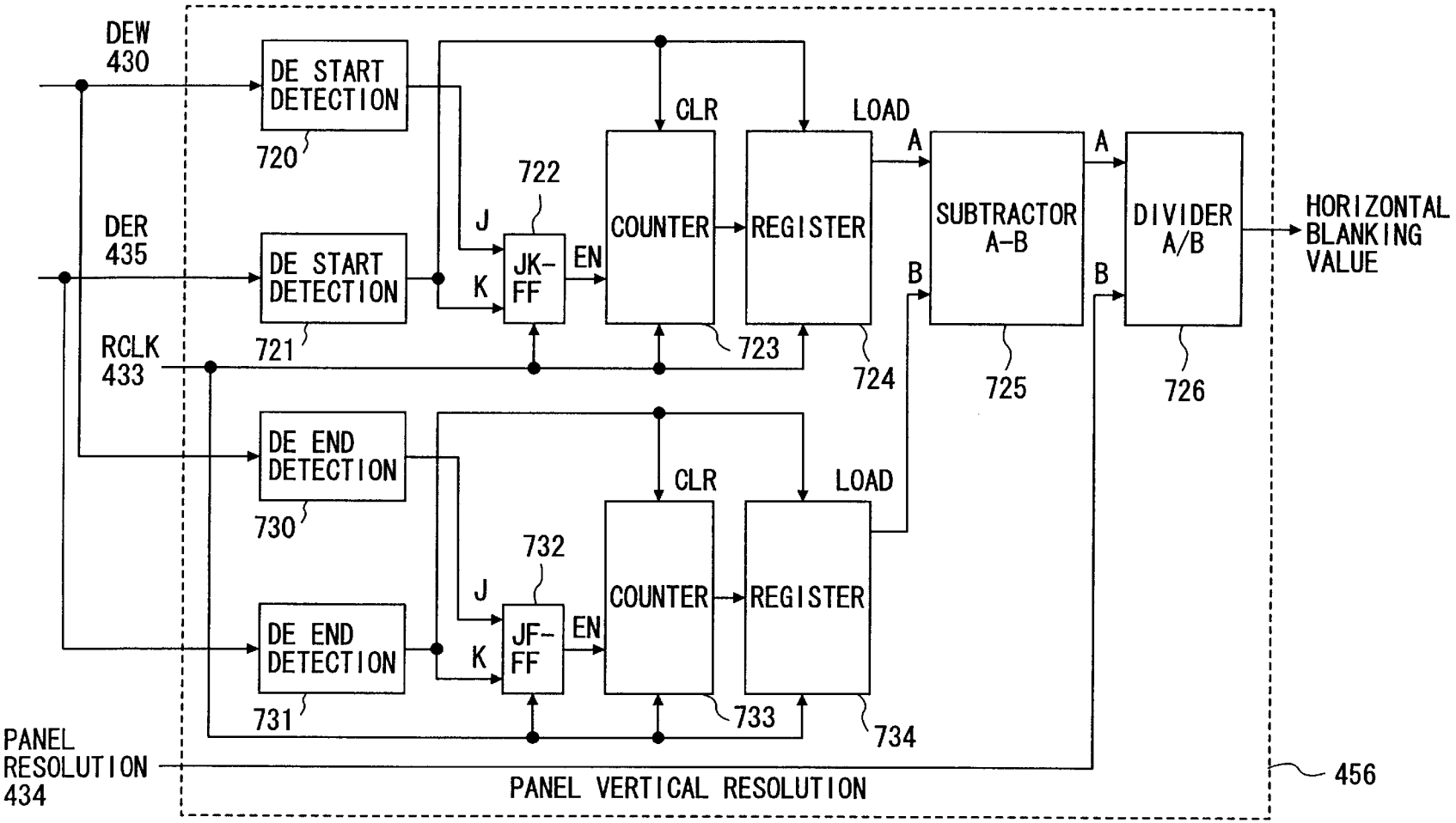
FIG. 9 is a block diagram showing a horizontal blanking setting circuit in a second variant example which may be additionally or alternatively provided in the above-mentioned first of the present invention.

FIG. 9 is a block diagram showing a horizontal blanking setting circuit 456 in a second variant example which may provided additionally or alternatively in the above-described first embodiment of the present invention.

The horizontal blanking setting circuit 456 shown in FIG. 9 includes DE start detecting circuits 720, 721, DE end detecting circuits 730, 731, JK-FF 722, 732, counters 723, 733, registers 724, 734, a subtractor 725 and a divider 726.

The DE start detecting circuits 720, 721 detect the beginnings of the active intervals of the DEW signal 430 and DER signal 435, respectively.

The RCLK signal 433 and the signals from the DE start detecting circuits 720, 721 are provided to the JK-FF 722. When the active interval of the DEW signal 430 starts, the JK-FF 722 outputs '1', and, when the active interval of the DER signal. 435 starts, outputs '0'.

To the counter 723, the RCLK signal 433, the signal from the JK-FF 722 and the signal from the DE start detecting circuit 721 are provided. The counter 723, then, uses the RCLK signal as a clock signal, counts the clock pulses thereof while the output of the JK-FF 722 is '1', and, provides the final count value to the register 724 in response to the signal from the DE start detecting circuit 721.

To the register 724, the RCLK signal 433, the count value from the counter 723 and the signal from the DE start detecting circuit 721 are provided. Then, the register 724 stores the count value of the counter 723. The register 724 provides the stored count value to the subtractor 725 in response to the signal from the DE start detecting circuit 721.

Similarly, the DE end detecting circuits 730 and 731 detect the ends of the active intervals of the DEW signal 430 and DER signal 435, respectively.

The outputs of the DE end detecting circuits 730 and 731 are used for measuring the interval from the end of the active interval of the DEW signal 430 to the end of the active interval of the DER signal 435*b* by the counter 733 and register 734. The register 734 provides the stored value to the subtractor 725.

The subtractor 725 subtracts the count value of the register 734 from the count value of the register 724, and provides the subtraction result to the divider 726.

The divider 726 divides the value from the subtractor 725 by the resolution in the vertical direction of the panel resolution circuit 434, the division result is added to the present DER horizontal blanking interval(which may have been obtained through the horizontal blanking interval setting circuit shown in FIG. 7 or the like), and, thus, a new horizontal blanking interval is obtained. This horizontal blanking interval is provided to the DER generating part 457.

Figure 10:
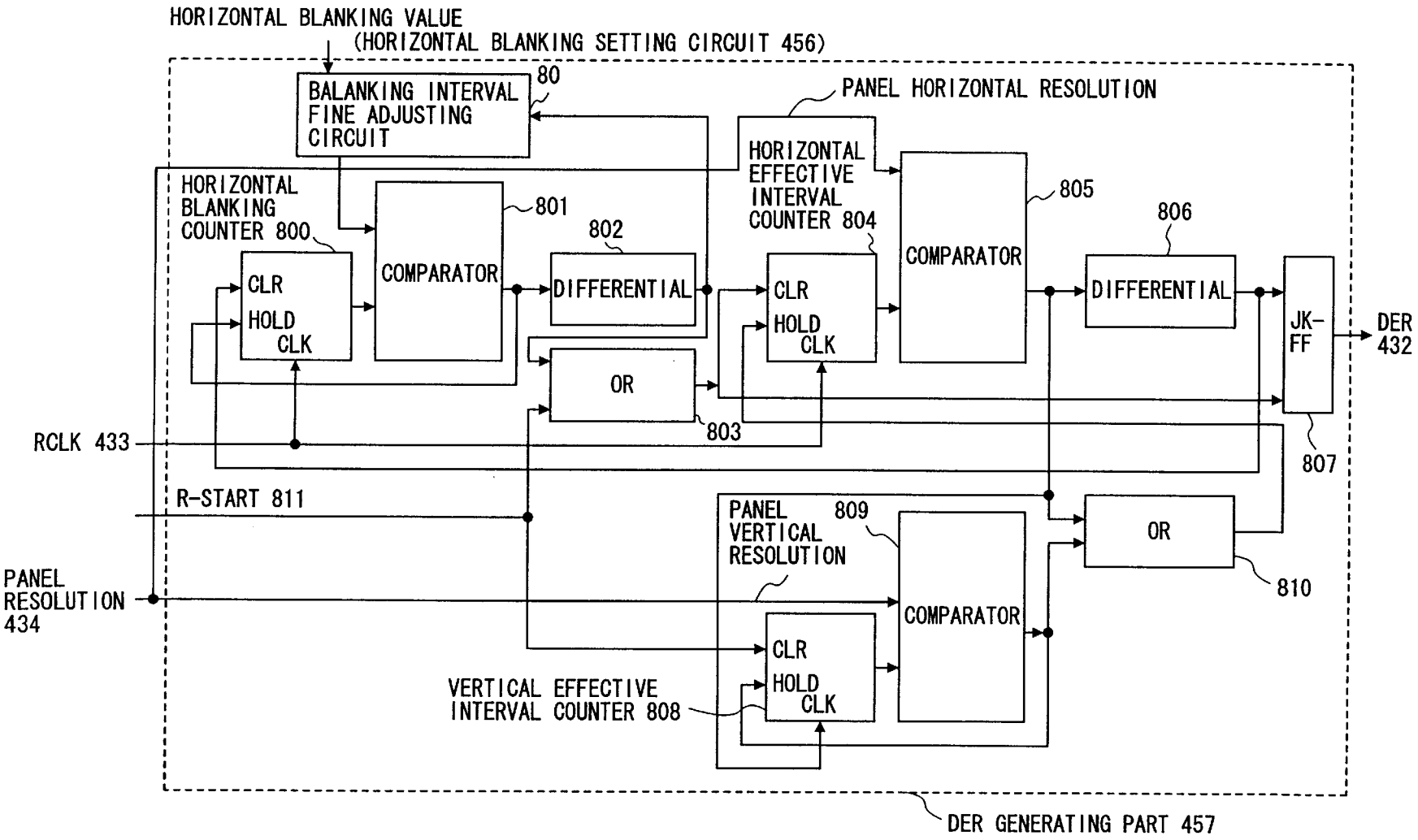
FIG. 10 is a block diagram showing a DER generating part shown in FIG. 5.

FIG. 10 is a block diagram showing the DER generating part 457 shown in FIG. 5.

As shown in FIG. 10, the DER generating part 457 includes a blanking interval fine adjusting circuit 80, a horizontal blanking counter 800, comparators 801, 805, 809, differential circuits 802, 806, OR circuits 803, 810, a horizontal effective interval counter 804, a vertical effective interval counter 808 and a JK-FF 807.

To the DER generating part 457, the horizontal blanking value from the horizontal blanking setting circuit 456, RCLK signal 433, panel resolution signal 434, and an R-START signal 811 which is a pulse generated when reading is started are provided.

To the blanking interval fine adjusting circuit 80, the horizontal blanking value from the horizontal blanking setting circuit 456 shown in FIG. 7, 8 or 9, and the signal from the differential circuit 802 are provided. Then, the blanking interval fine adjusting circuit 80 adjusts the horizontal blanking value, and provides the thus-adjusted horizontal blanking value to the comparator 801.

To the horizontal blanking counter 800, the output of the comparator 801, the output of the differential circuit 806, and the RCLK signal 433 are provided. Then, the horizontal blanking counter 800 counts the clock pulses of the RCLK signal 433, clears the count value in response to the output of the differential circuit 806, and stops the counting operation in response to the output of the comparator 801. The horizontal blanking counter 800 provides the count value to the comparator 801.

The comparator 801 compares the horizontal blanking value with the count value from the horizontal blanking counter 800. When the count value of the horizontal blanking counter 800 becomes larger than the horizontal blanking value, the comparator 801 provides a signal in a high level. This signal in the high level is provided to the horizontal blanking counter 800 and differential circuit 802.

When the output of the comparator 801 becomes the high level, the horizontal blanking counter 800 stops the counting operation. The differential circuit 802 differentiates the output of the comparator 801, and outputs the differential result to the blanking interval fine adjusting circuit 80 and OR circuit 803.

To the OR circuit 803, the R-START signal 811 and the output of the differential 802 are provided, and, then, the OR circuit 803 performs OR operation thereon, and outputs the operation result to the horizontal effective interval counter 804 and JK-FF 807. Thereby, the count value of the horizontal effective interval counter 804 is cleared, and the JK-FF 807 outputs '1' as the DER signal 432.

To the horizontal effective interval counter 804, the outputs of the OR circuits 803, 810, and the RCLK signal 422 are provided. Then, the horizontal effective interval counter 804 counts the pulses of the RCLK signal 433, clears the count value in response to the output of the OR circuit 803, and stops the counting operation in response to the output of the OR circuit 810. The horizontal effective interval counter 804 provides the count value to the comparator 805.

The comparator 805 compares the horizontal resolution of the panel with the count value from the horizontal effective interval counter 804, and, when the count value of the horizontal effective interval counter 804 is larger than the horizontal resolution, outputs the high level. The output of the comparator 805 is provided to the OR circuit 810, differential circuit 806 and vertical effective interval counter 808.

To the vertical effective interval counter 808, the outputs of the comparators 805, 809, and the R-START signal 811 are provided. Then, the vertical effective interval counter 808 counts the pulses of the output of the comparator 805 treating them as clock pulses, clears the count value in response to the R-START signal 811, and stops the counting operation in response to the output of the comparator 809. The output of the vertical effective interval counter 808 is provided to the comparator 809.

The comparator 809 compares the vertical resolution of the panel with the count value from the vertical effective interval counter 808, and, when the count value of the counter 808 becomes larger than the vertical resolution, outputs the high level. The output of the comparator 809 is provided to the vertical effective interval counter 808 and OR circuit 810. When the output of the counter 809 becomes the high level, the vertical effective interval counter 808 stops the counting operation. Further, the output of the comparator 809 is provided to the vertical effective interval counter 808. The horizontal effective interval counter 804 stops the counting operation in response to the output of the OR circuit 810.

The differential circuit 806 differentiates the output of the comparator 805, and outputs the differential result to the JK-FF 807 and horizontal blanking counter 800. The count value of the horizontal blanking counter 800 is cleared by the output of the differential circuit 806. The JK-FF 807 outputs '0' as the DER signal 432 in response to the signal from the differential circuit 806.

Figures 11A, 11B, 11C:
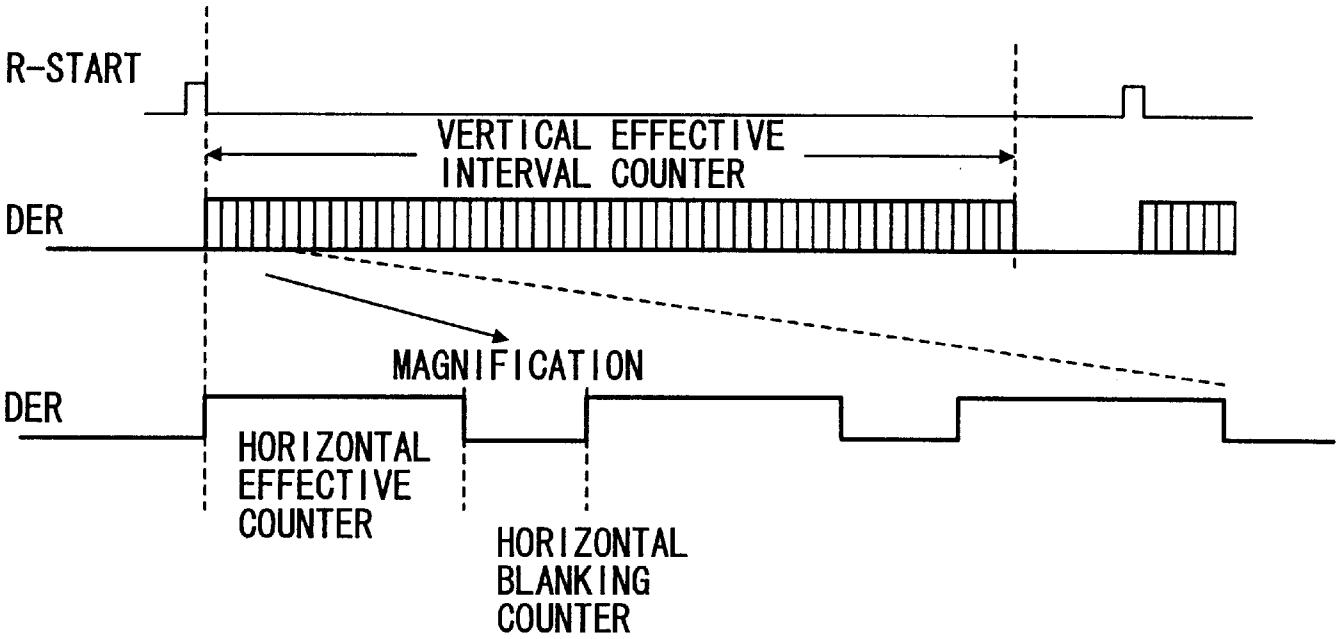
FIGS. 11A, 11B and 11C show waveforms of a DER signal used in the above-mentioned first embodiment of the present invention.

FIGS. 11A, 11B and 11C show waveforms of the DER signal used in the above-discribed first embodiment of the present invention.

FIG. 11A shows the R-START signal 811 input to the DER generating part 457 shown in FIG. 10. FIGS. 11B and 11C show the DER signal output from the DER generating part 457.

When the R-START signal shown in FIG. 11A becomes the high level as a pulse, the DER signal shown in FIG. 11B performs oscillation during the vertical effective interval as shown in the figure. FIG. 11C shows a magnified view of a part of FIG. 11B. As shown in FIG. 11C, the DER signal has the high level by the output of the horizontal effective counter and has the low level by the output of the horizontal blanking counter.

Figure 12:
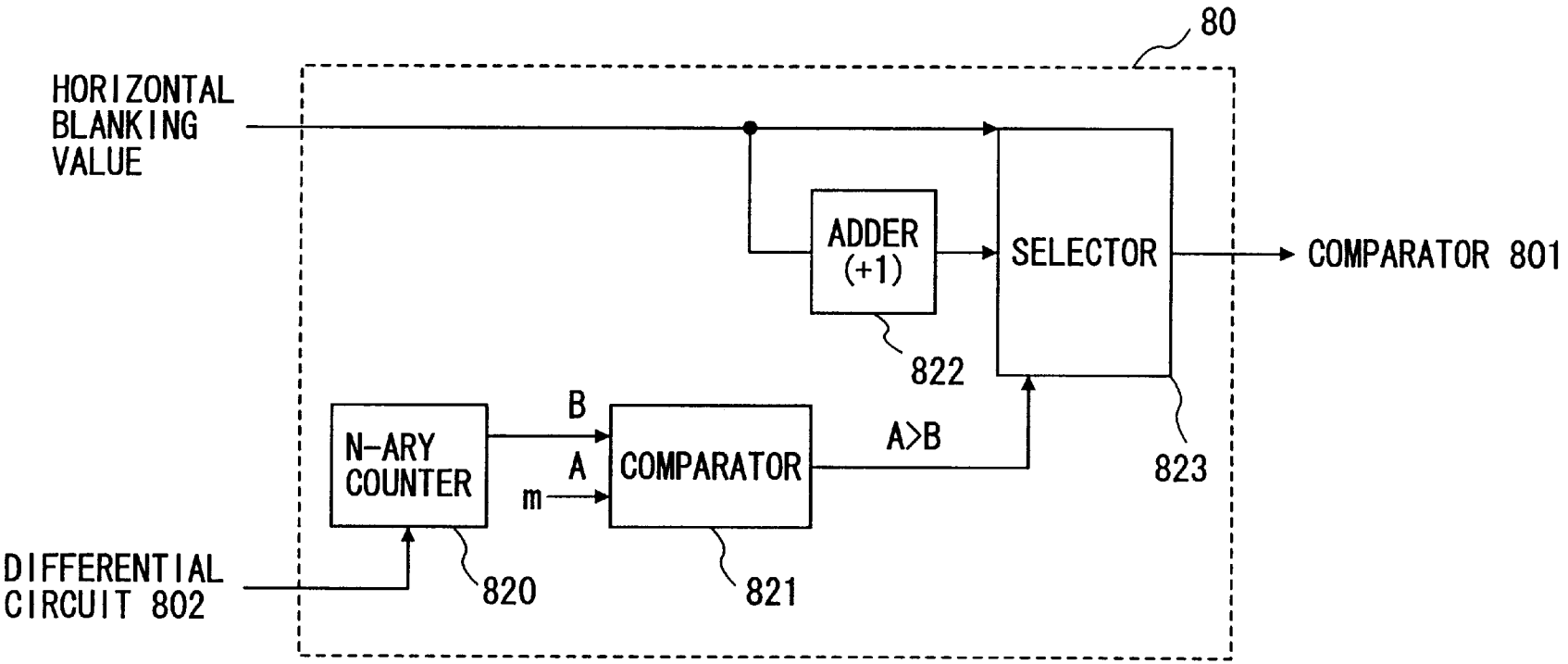
FIG. 12 is a block diagram showing a blanking interval fine adjusting circuit shown in FIG. 10.

FIG. 12 is a block diagram showing the blanking interval fine adjusting circuit 80 shown in FIG. 10 which deals with the horizontal blanking value provided from the horizontal blanking setting circuit.

As shown in FIG. 12, the blanking interval fine adjusting circuit 80 includes an n-ary counter 820, a comparator 821, an adder (+1) 822, and a selector 823.

For example, in the blanking interval fine adjusting circuit 80, setting is made such that, 'n' of the n-ary counter 820 is assumed such as n=4, 'm' is set such as m=0 when the value k in the decimal places of the output of the divider when the horizontal blanking value is output thereby is such as k=0 through 0.25; m=1 when k=0.26 through 0.5; m=2 when k=0.51 through 0.75; and m=3 when k=0.76 through 0.99.

The n-ary counter 820 counts the pulses of the signal output from the differential circuit 802 according to the 4-ary counting system, and the count value is provided to the comparator 821.

To the comparator 821, the count value of the 4-ary counter 820 is provided as an input B, and the value of m is provided as an input A. The comparator 821 outputs '1' to the selector 823 when A>B. Accordingly, for example, the input B of the comparator 821 changes in the sequence such as 0, 1, 2, 3, 0, . . . Then, when A=0, the output is such as 0, 0, 0, 0, 0, . . . When A=1, the output is such as 1, 0, 0, 0, 1, . . . When A=2, the output is such as 1, 1, 0, 0, 1, . . . When A=3, the output is such as 1, 1, 1, 0, 1, . . .

To the selector 823, the horizontal blanking value, and the value obtained as a result of 1 being added to the horizontal blanking value through the adder 822 are provided. The selector 823 outputs one thereof according to the value from the comparator 821 so that the selector 823 outputs the value obtained as a result of 1 being added to the horizontal blanking value m times of 4 times of output from the comparator 821.

Figure 13:
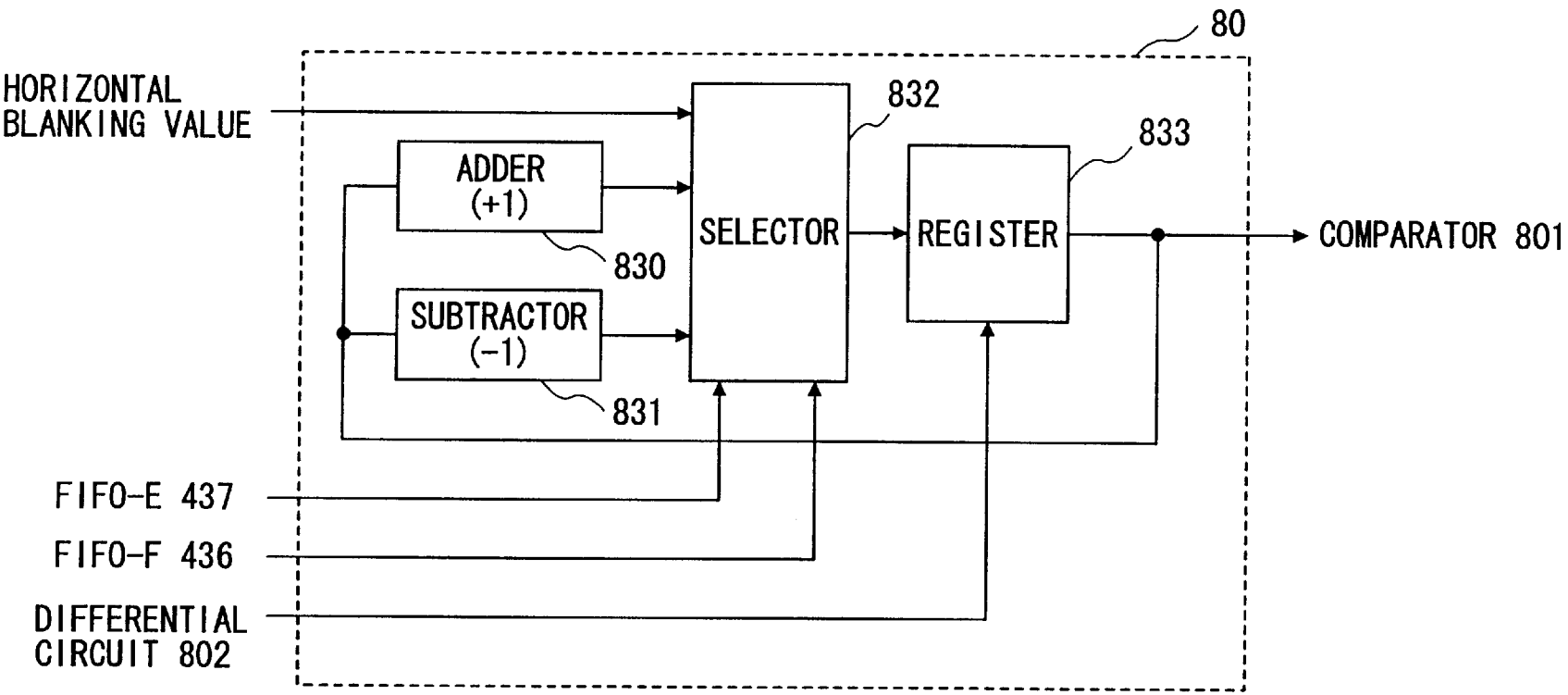
FIG. 13 is a block diagram showing the blanking interval fine adjusting circuit in a variant example of the above-mentioned first embodiment of the present invention.

FIG. 13 is a block diagram showing another example of the blanking interval fine adjusting circuit 80 shown in FIG. 10 which deals with the horizontal blanking value provided from the horizontal blanking setting circuit.

As shown in FIG. 13, the blanking interval. fine adjusting circuit 80 shown in FIG. 13 includes an adder (+1) 830, a subtractor (−1) 831, a selector 832 and a register 833.

To the selector 832, a FIFO-E signal 437, a FIFO-F signal 436, the horizontal blanking value from the horizontal blanking setting circuit 456, the output of the adder 830, and the output of the subtractor 831 are provided.

The FIFO-E signal 437 is a signal generated when the capacity of the FIFO 450 becomes empty. The FIFO-F signal 436 is a signal generated when the capacity of the FIFO 450 becomes full.

When the FIFO-E signal 437 and FIFO-F signal 436 have the low levels, the selector 832 provides the horizontal blanking value as it is to the register 833. The register 833 outputs the horizontal blanking value to the comparator 801 of the DER generating part 457.

When reading of data from the FIFO 450 comes to be performed more times than writing of data thereto, and the FIFO-E signal 437 is generated, the selector 832 selects the output of the adder 830, and thus, outputs the value obtained as a result of 1 being added to the value of the register 833. That is, as a result of the 1 being added to the output value, the horizontal blanking interval is elongated, and thereby, the rate of reading of data from the FIFO 450 is made slower.

On the other hand, when writing of data to the FIFO 450 comes to be performed more times than reading of data therefrom, and the FIFO-F signal is generated, the output of the subtractor 831 is selected, and, thereby, the value obtained as a result of 1 being subtracted from the value of the register 833 is output therefrom. That is, the horizontal blanking interval is shortened, and, reading of data from the FIFO 450 is performed more quickly.

Figure 14:
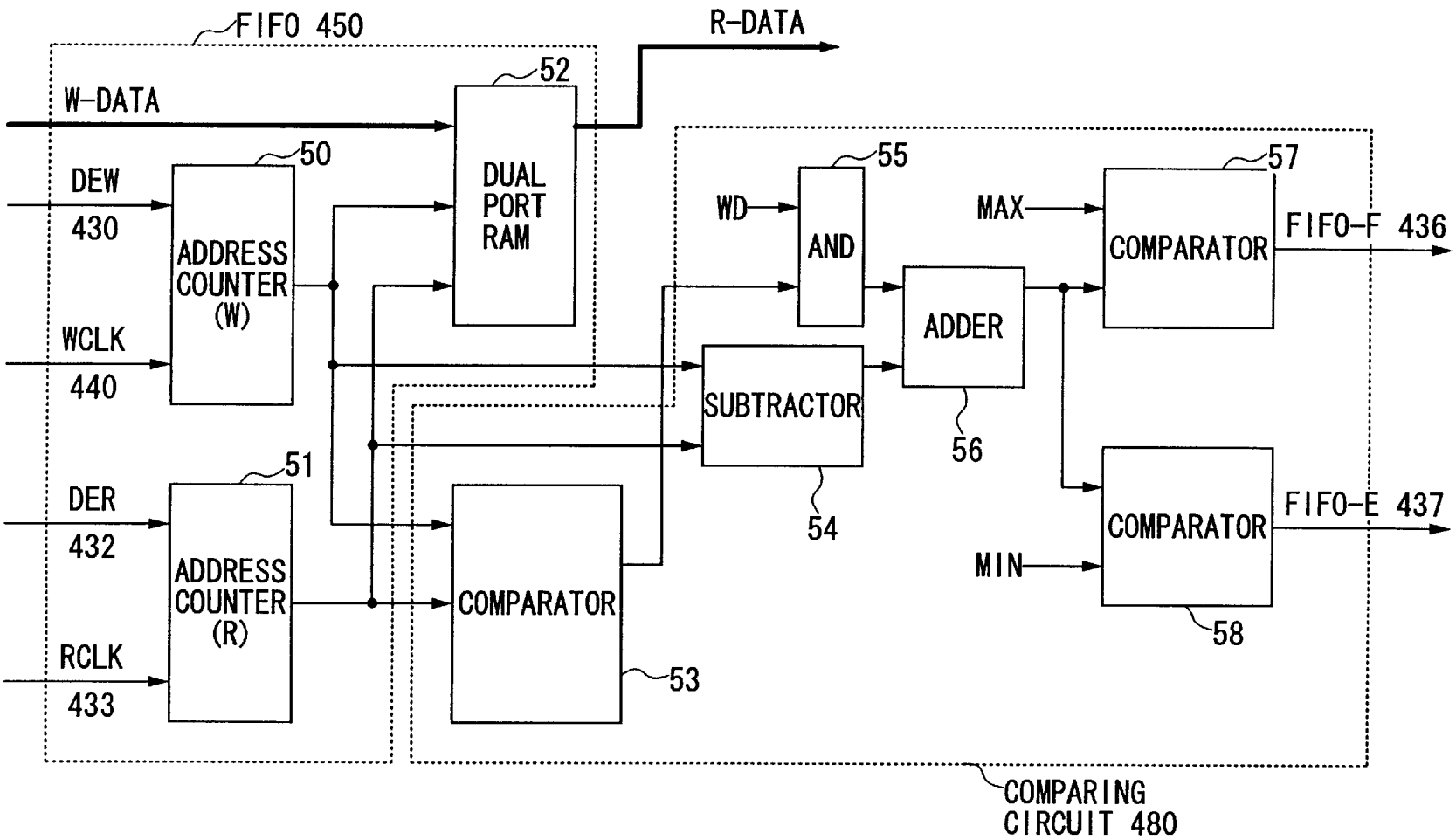
FIG. 14 is a block diagram showing a FIFO shown in FIG. 5 together with a comparing circuit which may be added when the blanking interval fine adjusting circuit shown in FIG. 13 is used.

FIG. 14 is a block diagram showing the FIFO 450 shown in FIG. 5 and a comparing circuit 480, which is added when the blanking interval fine adjusting circuit 80 shown in FIG. 13 is used, in the first embodiment of the present invention.

In FIG. 14, the FIFO 450 includes an address counter 50 for writing, an address counter 51 for reading, and a Dual-Port-RAM 52.

Based on the signals from the address counters 50, 51, the Dual-Port-RAM 52 performs storage of W-data and output of R-data.

To the address counter 50, the DEW signal 430 and WCLK signal 440 are provided. Then, the address counter 50 counts the address for writing, and sets the address in the Dual-Port-RAM for data storage thereto. To the address counter 51, the DER signal 432 and RCLK signal 433 are provided. Then, the address counter 51 counts the address for reading, and sets the address in the Dual-Port-RAM for data output therefrom. The outputs of the address counters 50, 51 are provided to the Dual-Port-RAM 52, a comparator 53 and a subtractor 54.

The comparing circuit 480 includes comparators 53, 57, 58, the subtractor 54, an AND circuit 55, and an adder 56. This comparing circuit 480 generates the FIFO-F signal 436 and FIFO-E signal 437 input to the blanking interval fine adjusting circuit 80 shown in FIG. 13.

To the comparator 53, the values from the address counter (W) 50 and address counter (R) 51 are provided. The comparator 53 outputs '0' to the AND circuit 55 when the value of the address counter (W) 50 is larger than the value of the address counter (R) 51. The comparator 53 outputs '1' to the AND circuit 55 when the value of the address counter (R) 51 is larger than the value of the address counter (W) 50.

The AND circuit 55 outputs '0' to the adder 56 when the input from the comparator 53 is '0'. The AND circuit 55 outputs a WD value which is the value of word length of the FIFO 450, to the adder 56 when the input from the comparator 53 is '1'.

The subtractor 54 subtracts the value of the address counter (R) 51 from the value of the address counter (W) 50, and outputs the subtraction result to the adder 56.

The adder 56 adds the output of the subtractor 54 to the output of the AND circuit 55, and outputs the addition result to the comparators 57, 58.

The comparator 57 compares the output of the adder 56 with a predetermined value MAX. When the value of the adder 56 is larger than MAX, the comparator 57 outputs '1' as the FIFO-F signal 436. That is, when the difference between the amount of data written to the Dual-Port-RAM 52 and the amount of data read out from the same becomes equal to or larger than MAX, the FIFO-F 436 is output therefrom.

The comparator 58 compares the output of the adder 56 with a predetermined value MIN. When the value of the adder 56 is smaller than MIN, the comparator 58 outputs '1' as the FIFO-E signal 437. That is, when the difference between the amount of data read out from the Dual-Port-RAM 52 and the amount of data written to the same becomes equal to or smaller than MAX, the FIFO-F 436 is output.

Figure 15:
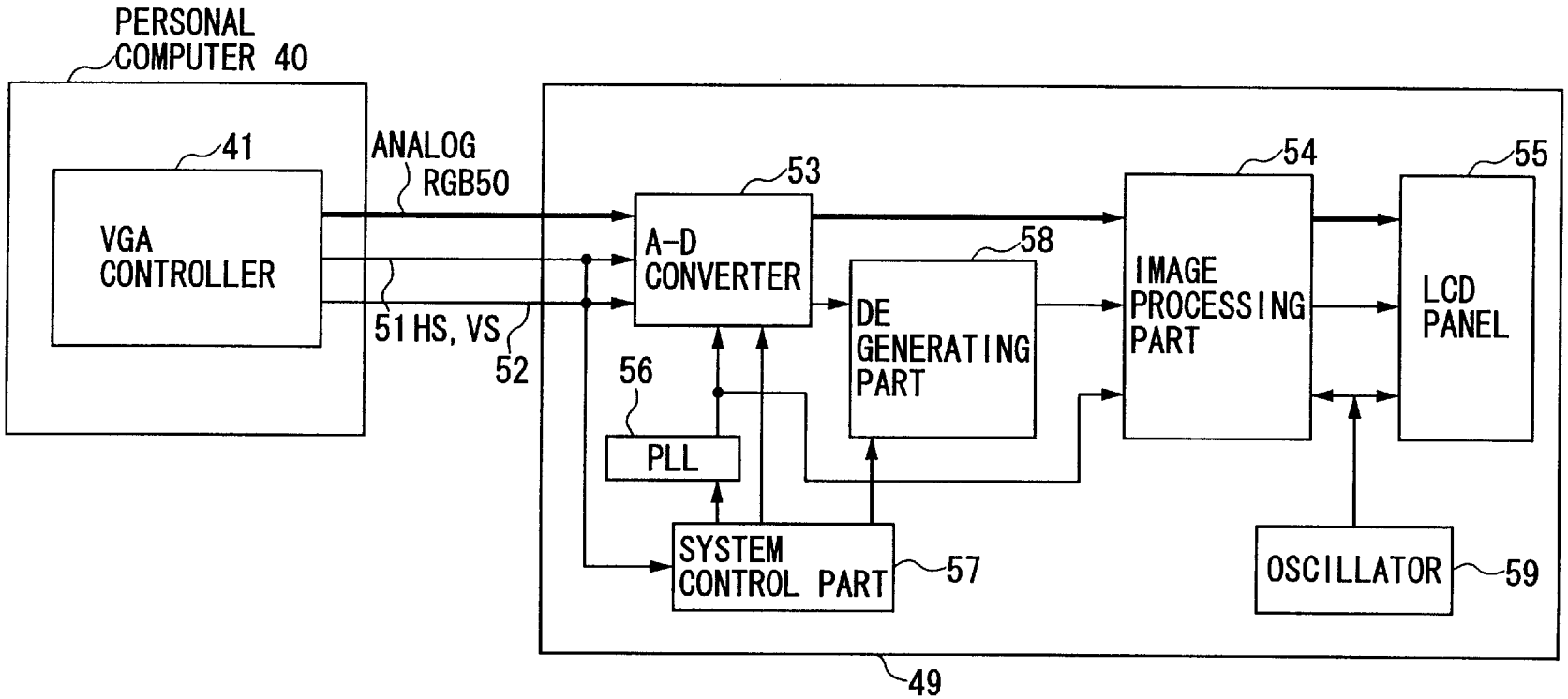
FIG. 15 is a block diagram showing an image display device in a second embodiment of the present invention.

FIG. 15 is a block diagram showing an image display device in a second embodiment of the present invention.

As shown in FIG. 15, the image display device 49 in the second embodiment is a device of driving a dot-matrix display device by using an analog image signal, and, performs display based on the image signal from a personal computer 40. The personal computer 40 includes a VGA controller 41, and so forth (not shown in the figure).

The personal computer 40 provides analog video signals including an RGB signal 50, an HS signal 51 and a VS signal 52 to the image display device 49.

The image display device 49 includes an A-D converter 53, an image processing part 54, an LCD panel 55, a PLL circuit 56, a system control part 57 a DE generating part 58 and an oscillator 59.

In the image display device 49, the analog video signals (RGB signal 50, HS signal 51 and VS signal 52) are provided to the A-D converter 53. The HS signal 51 and VS signal 52 are also provided to the system control part 57.

The A-D converter 53 converts the analog video signals into digital video signals, and provides the signals to the image processing part 54 and DE generating part 58.

The system control part 57, in synchronization with the HS signal 51 and VS signal 52, controls the PLL circuit 56, A-D converter 53 and DE generating part 58.

The PLL circuit 56 provides a clock signal in phase with the HS and VS signals to the A-D converter 53, and controls the conversion timing of the A-D converter 53.

The DE generating part 58 uses the digital signals from the A-D converter 53, generates a DE signal according to a control signal from the system control part 57, and provides the DE signal to the image processing part 54.

The image processing part 54 has the digital signal from the A-D converter 53, DE signal from the DE generating part 58 and clock signal from the PLL circuit 56 provided thereto. Then, the image processing part 54 converts the digital signal provided from the A-D converter 53 into a signal of resolution corresponding to the LCD panel 55 based on the provided DE signal and CLK signal (clock signal from the PLL circuit 56). The image signal thus obtained so as to be made suitable for the LCD panel 55 and synchronized with the signal from the oscillator 59 is sent to the LCD panel 55.

The oscillator 59 provides the clock signal having the frequency corresponding to the resolution of the LCD panel 55 to the image processing part 54 and LCD panel 55. This clock signal is set so as to be in synchronization with the DE signal and CLK signal.

The LCD panel 55 displays an image corresponding to the resolution of the LCD panel 55 by using the image signal from the image processing part 54 and the clock signal from the oscillator 59.

Figure 16:
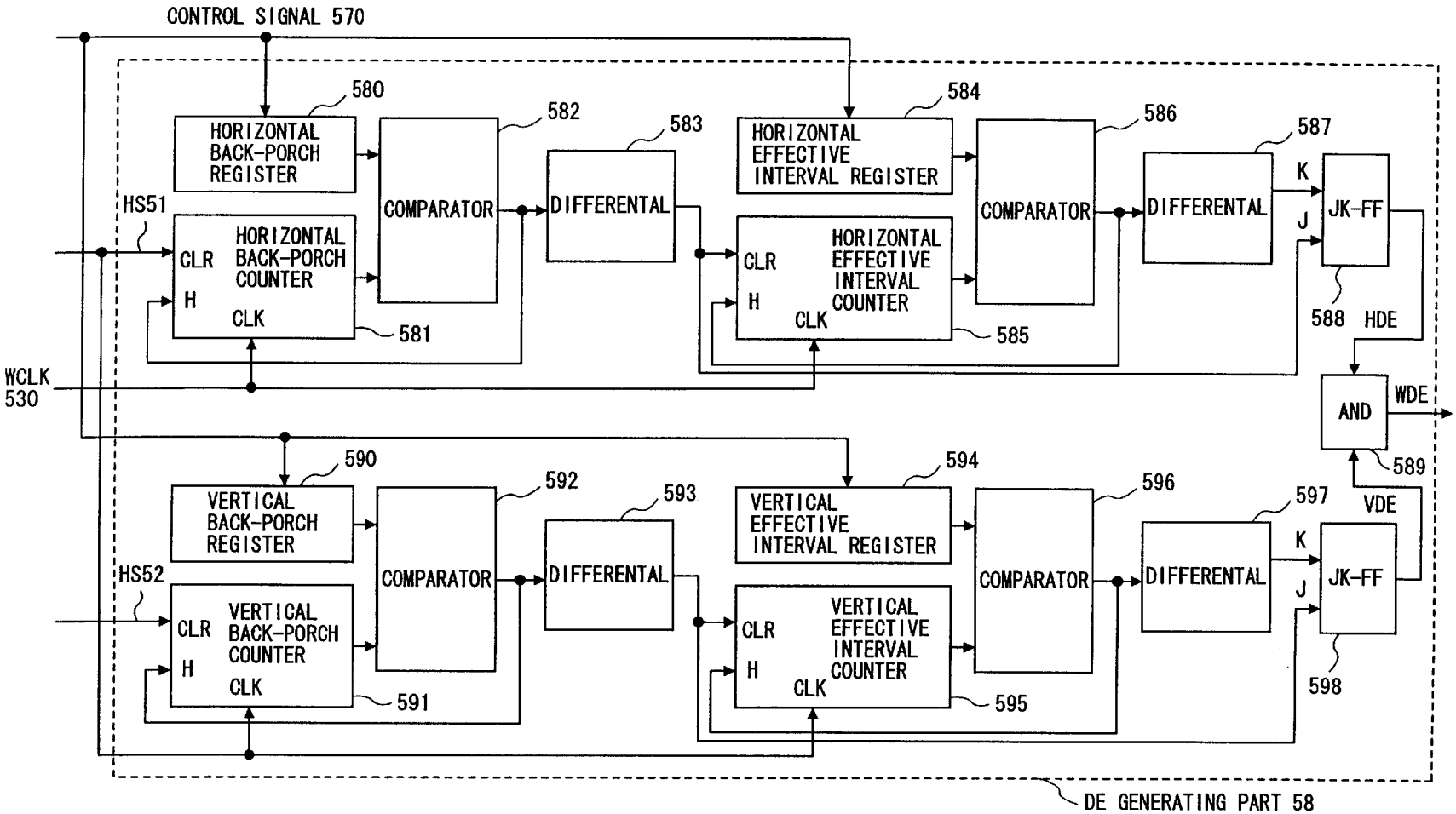
FIG. 16 is a block diagram showing a DE generating part shown in FIG. 15.

FIG. 16 is a block diagram showing the DE generating part 58 shown in FIG. 15.

As shown in FIG. 16, the DE generating part 58 includes a horizontal back-porch register 580, a vertical back-porch register 590, a horizontal back-porch counter 581, a vertical back-porch counter 591, comparators 582, 592, 586, 596, differential circuits 583, 593, 587, 597, a horizontal effective interval register 584, a vertical effective interval register 594, a horizontal effective interval counter 585, a vertical effective interval counter 595, JK-FF 588, 598, and an AND circuit 589.

The horizontal back-porch register 580 has a control signal 570 input thereto from the system control part 57, and, outputs the signal to the comparator 582.

The horizontal back-porch counter 581 has the HS signal 51, the output of the comparator 582 and the writing clock (WCLK) signal 530 provided thereto. The horizontal back-porch counter 581 counts the clock pulses of the WCLK signal 530, and clears the count value in response to the high level of the HS signal 51. Further, the horizontal back-porch counter 581 stops the counting operation in response to the output of the comparator 582. The output of the horizontal back-porch counter 581 is provided to the comparator 582.

The comparator 582 compares the value of the horizontal back-porch register 580 with the value of the horizontal back-porch counter 581, and, when they become equal to one another, outputs the high level. The output of the comparator 582 is provided to the horizontal back-porch counter 581 and differential circuit 583.

When the output of the comparator 582 becomes the high level, the horizontal back-porch counter 581 stops the counting operation. The differential circuit 583 differentiates the output of the comparator 582, and outputs the differential result to the horizontal effective interval counter 585 and JK-FF 588.

The horizontal effective interval register 584 has the control signal 570 input thereto from the system control part 57, and outputs the signal to the comparator 586.

The horizontal effective interval counter 585 has the output of the differential circuit 583, the output of the comparator 586 and the WCLK signal 580 provided thereto. The horizontal effective interval counter 585 counts the clock pulses of the WCLK signal 530, and clears the count value in response to the signal from the differential circuit 583. Further, the horizontal effective interval counter 585 stops the counting operation in response to the output of the comparator 586. The output of the horizontal effective interval counter 585 is provided to the comparator 586.

The comparator 586 compares the value of the horizontal effective interval register 584 with the value of the horizontal effective interval counter 585, and, when they become equal to one another, outputs the high level. The output of the comparator 586 is provided to the horizontal effective interval counter 585 and differential circuit 587.

The horizontal effective interval counter 585 stops the counting operation when the output of the comparator 586 becomes the high level. The differential circuit 587 differentiates the output of the comparator 586, and outputs the differential result to the JK-FF 588.

The JK-FF 588 has the signals from the differential circuits 583 and 587 provided thereto. The JK-FF 588 outputs the DE (HDE) signal in the horizontal direction to the AND circuit 589.

On the other hand, the vertical back-porch register 590 has the control signal 570 input thereto from the system control part 57, and outputs the signal to the comparator 592.

The vertical back-porch counter 591 has the VS signal 52, HS signal 51 and the output of the comparator 592 provided thereto. The vertical back-porch counter 591 counts the pulses of the HS signal 51 as treating them as clock pulses, has the count value thereof cleared in response to the VS signal 52, and stops the counting operation when the output of the comparator 592 becomes the high level. The output of the vertical back-porch counter 591 is provided to the comparator 592.

The comparator 592 compares the value of the vertical back-porch register 590 with the value of the vertical back-porch counter 591, and, when they become equal to one another, outputs the high level. The output of the comparator 592 is provided to the vertical back-porch counter 591 and differential circuit 593.

When the output of the comparator 592 becomes the high level, the vertical back-porch counter 591 stops the counting operation. The differential circuit 593 differentiates the output of the comparator 592, and outputs the differential result to the vertical effective interval counter 595 and JK-FF 598.

The vertical effective interval register 594 has the control signal 570 input thereto from the system control part 57, and outputs the signal to the comparator 596.

The vertical effective interval counter 595 has the output of the differential circuit 593, the output of the comparator 596 and the HS signal 51 provided thereto. The vertical effective interval counter 595 counts the pulses of the HS signal 51 as treating them as clock pulses, has the count value thereof cleared by the signal from the differential circuit 593, and stops the counting operation in response to the output of the comparator 596. The output of the vertical effective interval counter 595 is provided to the comparator 596.

The comparator 596 compares the value of the vertical effective interval register 594 with the value of the vertical effective interval counter 595, and, when they become equal to one another, outputs the high level. The output of the comparator 596 is provided to the vertical effective interval counter 595 and differential circuit 597.

When having the output of the comparator 596 provided thereto, the vertical effective interval counter 595 stops the counting operation. The differential circuit 597 differentiates the output of the comparator 596 and outputs the differential result to the JK-FF 598.

The JK-FF 598 has the signals from the differential circuits 593, 597 provided thereto, and outputs the DE (VDE) signal for the vertical direction to the AND circuit 589.

The AND circuit 589 performs AND operation on the HDE signal and VDE signal, thus, generates a writing DE (WDE) signal, and provides the signal to the image processing part 54.

Figure 17:
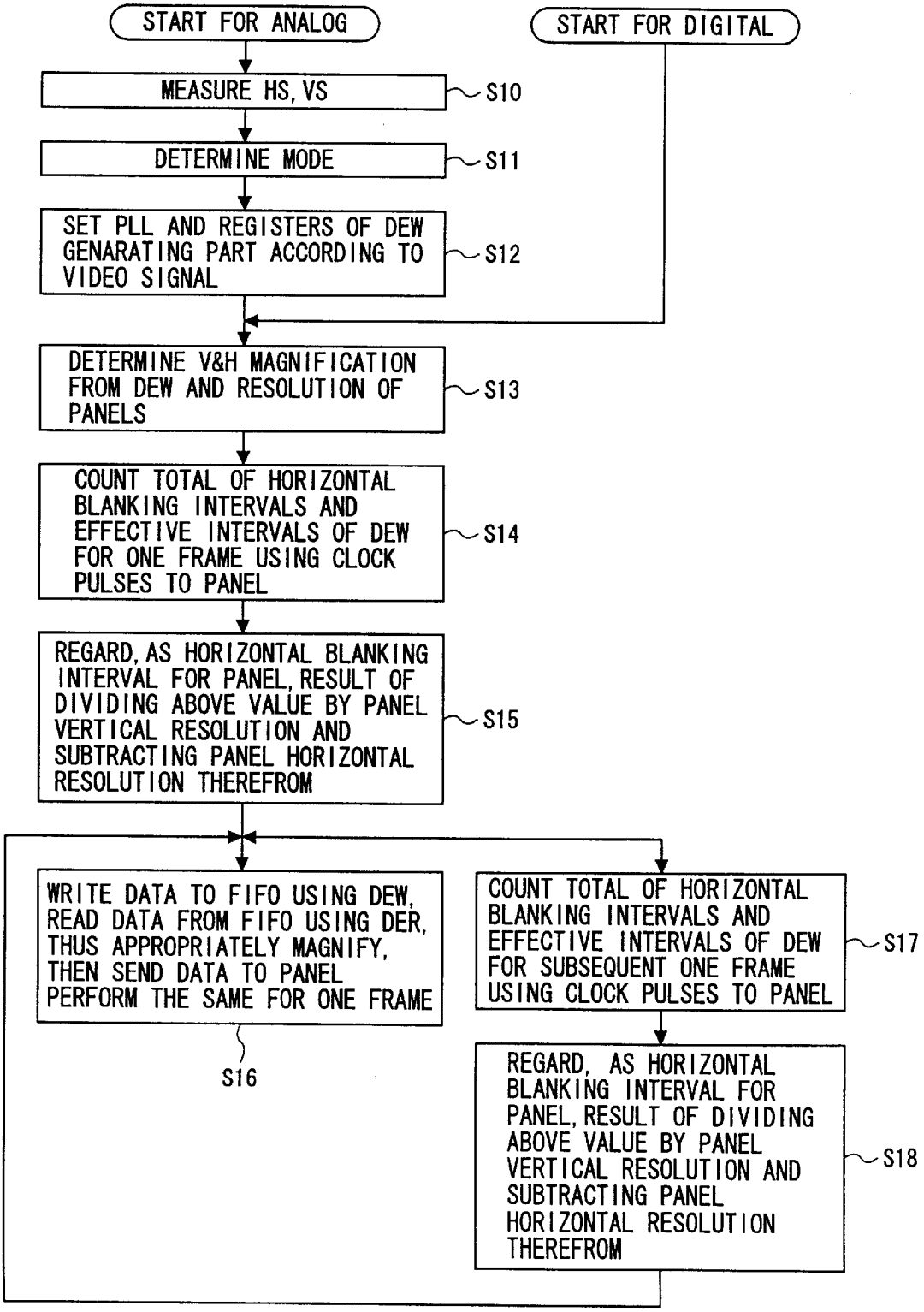
FIG. 17 is a flow chart showing image processing which may be performed in the image display device in the above-mentioned first embodiment of the present invention.

FIG. 17 shows a flow chart of image processing in a third embodiment of the present invention, which may be performed by the image display device in the above-described first embodiment of the present invention.

With regard to FIG. 17, when image processing is performed on the analog signal, steps S10 through S12 are performed first.

In the step S10, the HS signal and VS signal from the VGA controller are measured. In the step S11, a mode of the display device is determined from the result of the measurement of the HS and VS signals. In the step S12, the registers of the PLL circuit and DEW circuit are set according to the video signal such as the RGB signal.

The following process is performed either on the analog signal or on the digital signal. In a step S13, by using the DEW signal and resolution of the display panel, the magnification is determined by the image processing part. In a step S14, the total of the horizontal blanking intervals and effective intervals of the DEW signal for one frame of an image is counted by using the clock pulses to be sent to the display panel. In a step S15, the value counted in the step S14 is divided by the vertical resolution of the display panel, then, therefrom, the horizontal resolution of the display panel is subtracted, and the result thereof is determined as the horizontal blanking interval for the display panel. On the value of the horizontal blanking interval obtained in the step S15, the process of a step S16 and the process of steps S17 and S18 are performed in parallel.

In the step S16, for one frame of image, writing of data to the FIFO is performed by using the DEW signal, reading of data from the FIFO is performed by using the DER signal, magnification is performed so as to cause the data to become suitable for the display panel, and the thus-magnified data is sent to the display panel.

In the step S17, the total of the horizontal blanking intervals and the effective intervals of the DEW signal for the subsequent one frame is counted by using the clock pulses to be sent to the display panel.

In the step S18, the value obtained in the step S17 is divided by the vertical resolution of the display panel, then, therefrom, the value of the horizontal resolution is subtracted, and the result thereof is determined as the horizontal blanking interval for the display panel. Thus, the horizontal blanking interval is determined, and, by using the thus-determined horizontal blanking interval, writing to the FIFO and reading therefrom are controlled.

Figure 18:
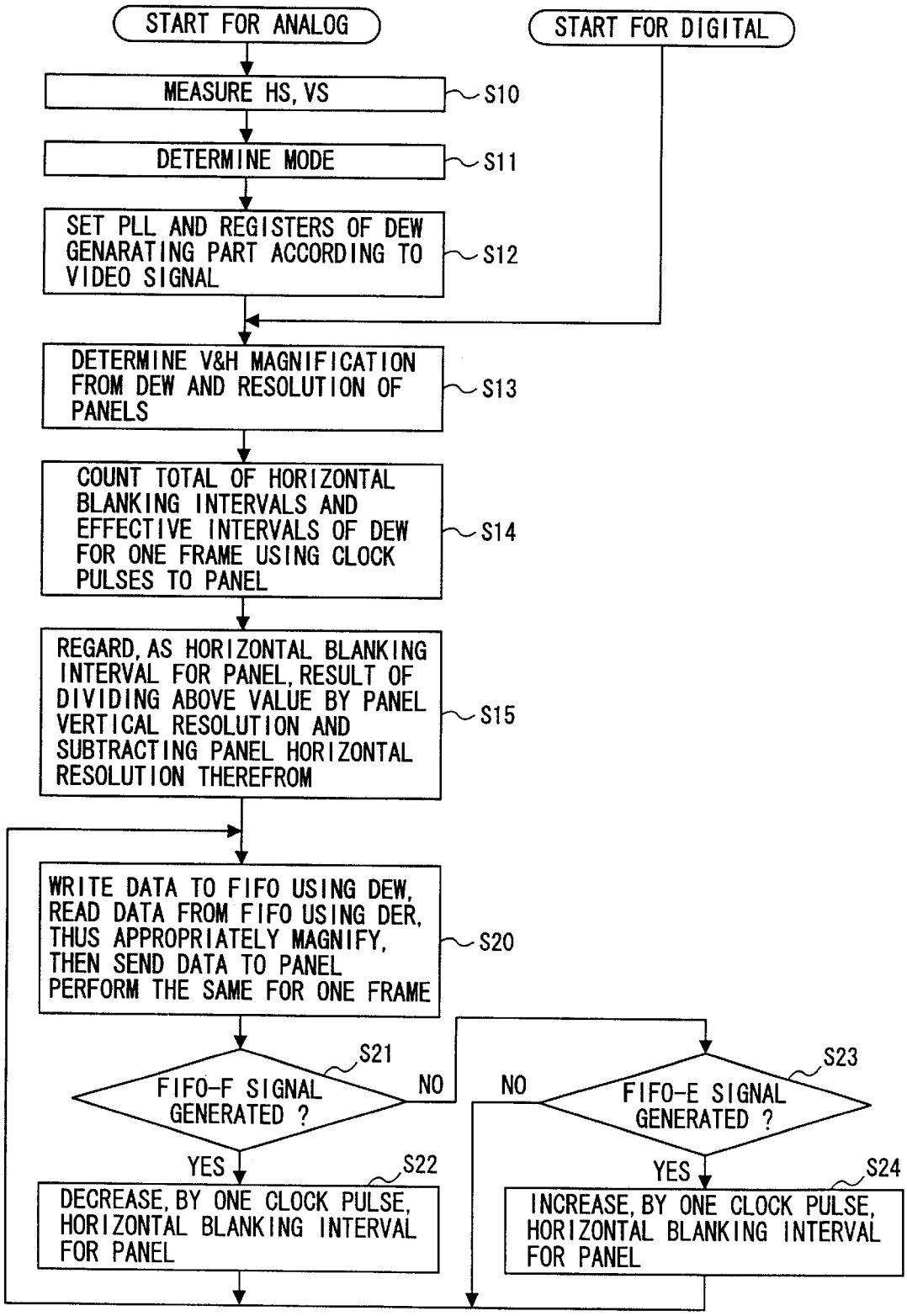
FIG. 18 is a flow chart showing image processing which may be performed in the variant example of the image display device of the above-mentioned first embodiment of the present invention employing the configuration shown in FIGS. 13 and 14.

FIG. 18 shows a flow chart of image processing in a fourth embodiment of the present invention, which may be performed by the image display device in the above-mentioned first embodiment of the present invention when the configuration shown in FIGS. 13 and 14 is employed.

In FIG. 18, the steps S10 through S15 are the same as those of FIG. 17 described above.

In a step S20, for one line of an image, writing of data to the FIFO is performed by using the DEW signal, reading data from the FIFO is performed by using the DER signal, then, magnification is performed so that the data is magnified so as to become suitable to the resolution of the display panel, and the thus-magnified data is sent to the panel.

In a step S21, it is determined whether the FIFO-F signal is generated, that is, whether the data written to the FIFO becomes full of the capacity thereof. When the FIFO-F signal is generated, a step S22 is performed. In the step S22, the horizontal blanking value is subtracted by 1 (the horizontal blanking interval is shortened), and thus, the rate of reading data from the FIFO is made faster.

When the FIFO-F signal is not generated, a step S23 is performed. In the step S23, it is determined whether the FIFO-E signal is generated. When the FIFO-E signal is generated, a step S24 is performed. In the step S24, 1 is added to the horizontal blanking value (horizontal blanking interval is elongated), and, thereby, the rate of reading from the FIFO is made slower.

The present invention is not limited to the above-described embodiments, and variations and modifications may be made without departing from the scope of the present invention.

The present application is based on Japanese priority application No. 2000-237573, filed on Aug. 4, 2000, the entire contents of which are hereby incorporated by reference.

What is claimed is:

1. An image processing device, comprising:

a storing part storing image data of an input image signal; and a control part detecting a resolution of the image data from a synchronization signal which is in synchronization with the input image signal, and, controlling timing of reading the image data from said storing part according to the thus-detected resolution, wherein said control part has a data enable signal input thereto as the synchronization signal which is in synchronization with the input image signal, detects the number of data enable signal pulses within one frame of the input image signal in the data enable signal, and determines, as a magnification in a vertical direction, a value obtained as a result of a resolution in the vertical direction of an image to be output being divided by the thus-detected number of data enable signal pulses within one frame;

the data enable signal which is in synchronization with the input image signal and a clock signal which is in synchronization with the reading timing for the image data are provided to said control part;

a pulse width of the data enable signal is counted by using the clock signal, and, a value obtained as a result of a resolution in a horizontal direction of the image to be output being divided by a thus-obtained count value is determined as a magnification in the horizontal direction, by said control part; and said control part controls the timing of reading the image data from said storing part according to the thus-obtained magnification in the vertical direction and magnification in the horizontal direction.

2. An image processing device, comprising:

a storing part storing image data of an input image signal;

a clock generating part generating a predetermined clock signal according to the resolution of the image to be output; and a control part that:

detects periods of a horizontal synchronization signal and a vertical synchronization signal which are in synchronization with the input image signal, determines a magnification for an image to be output, from a horizontal synchronization interval and a vertical synchronization interval of the image to be output, and the periods of the horizontal synchronization signal and vertical synchronization signal which are in synchronization with the input image signal, controls timing of reading the image data from said storing part according to the thus-determined magnification, reads the image data from said storing part in synchronization with the clock signal generated by said clock generating part, counts an interval obtained as a result of a vertical blanking interval being removed from one frame of the image signal, using the clock signal generated by said clock generating part, sets, as a horizontal blanking interval for the image to be output, a value obtained from dividing a thus-obtained count value by a resolution in the vertical direction for the image to be output, and subtracting a resolution in the horizontal direction for the image to be output from a division result, and reads the image data from said storing part according to the thus-set horizontal blanking interval and the magnification.

3. The image processing device as claimed in claim 2, wherein said control part updates the horizontal blanking interval for each frame of the input image signal.

4. The image processing device as claimed in claim 2, wherein said control part updates the horizontal blanking interval according to a difference between a writing time and a reading time for said storing part.

5. The image processing device as claimed in claim 2, wherein said control part updates the horizontal blanking interval according to a data amount of said storing part.

6. An image processing method, comprising:

a) storing image data of an input image signal in a storing part; and b) detecting a resolution of the image data from a synchronization signal which is in synchronization with the input image signal, and, controlling timing of reading the image data from said storing part according to the thus-detected resolution, and said b) comprising b-1) using a data enable signal as the synchronization signal which is in synchronization with the input image signal;

b-2) detecting the number of data enable signal pulses within one frame of the input image signal in the data enable signal;

b-3) determining, as a magnification in a vertical direction, a value obtained as a result of a resolution in the vertical direction of an image to be output being divided by the thus-detected number of data enable signal pulses within one frame;

b-4) using a clock signal which is in synchronization with the reading timing for the image data;

b-5) counting a pulse width of the data enable signal by using the clock signal;

b-6) determining a value obtained as a result of a resolution in a horizontal direction of the image to be output being divided by a thus-obtained count value, as a magnification in the horizontal direction; and b-7) controlling the timing of reading the image data from said storing part according to the thus-obtained magnification in the vertical direction and magnification in the horizontal direction.

7. An image processing method, comprising:

a) storing image data of an input image signal in a storing part;

b) detecting periods of a horizontal synchronization signal and a vertical synchronization signal which are in synchronization with the input image signal;

c) determining a magnification for an image to be output, from a horizontal synchronization interval and a vertical synchronization interval of the image to be output, and the periods of the horizontal synchronization signal and vertical synchronization signal which are in synchronization with the input image signal;

d) controlling timing of reading the image data from said storing part according to the thus-determined magnification;

e) generating a predetermined clock signal according to the resolution of the image to be output;

f) reading the image data from said storing part in synchronization with the clock signal generated by said clock generating part;

g) counting an interval obtained as a result of a vertical blanking interval being removed from one frame of the image signal, using the clock signal generated by said clock generating part;

h) setting, as a horizontal blanking interval for the image to be output, a value obtained from dividing a thus-obtained count value by a resolution in the vertical direction for the image to be output, and subtracting a resolution in the horizontal direction for the image to be output from a division result; and i) reading, in said f), the image data from said storing part according to the thus-set horizontal blanking interval and the magnification.

8. The method as claimed in claim 7, further comprising the step j) updating the horizontal blanking interval for each frame of the input image signal.

9. The method as claimed in claim 7, further comprising the step j) updating the horizontal blanking interval according to a difference between a writing time and a reading time for said storing part.

10. The method as claimed in claim 7, further comprising the step j) updating the horizontal blanking interval according to a data amount of said storing part.

* * * * *